US007722143B2

(12) United States Patent
Yoshikawa et al.

(10) Patent No.: US 7,722,143 B2
(45) Date of Patent: May 25, 2010

(54) INK JET PRINTING APPARATUS AND METHOD OF PERFORMING A MAINTENANCE PROCESS

(75) Inventors: Hirokazu Yoshikawa, Kawasaki (JP); Hitoshi Nishikori, Inagi (JP); Yoshito Mizoguchi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/041,032

(22) Filed: Mar. 3, 2008

(65) Prior Publication Data

US 2008/0158273 A1 Jul. 3, 2008

Related U.S. Application Data

(63) Continuation of application No. PCT/JP2007/074462, filed on Dec. 19, 2007.

(30) Foreign Application Priority Data

Dec. 21, 2006 (JP) ..... 2006-344634

(51) Int. Cl.
*B41J 2/195* (2006.01)

(52) U.S. Cl. ..... 347/7

(58) Field of Classification Search ..... 347/7
See application file for complete search history.

(56) References Cited

U.S. PATENT DOCUMENTS 6,142,600 A 11/2000 Takahashi et al.
6,913,336 B2 * 7/2005 Hara ..... 347/7
6,951,382 B2 10/2005 Inui et al.
6,984,009 B2 1/2006 Nakagawa et al.
7,354,133 B2 4/2008 Ide et al.
2005/0219309 A1 10/2005 Uchida

FOREIGN PATENT DOCUMENTS

JP 7-017058 1/1995
JP 9-300645 11/1997
JP 09300645 A * 11/1997
JP 2003-291368 10/2003
JP 2003-320686 11/2003
JP 2004-098626 4/2004
JP 2004-174832 6/2004
JP 2005-306013 11/2005

* cited by examiner

*Primary Examiner*—Stephen D Meier
*Assistant Examiner*—Alexander C Witkowski
(74) *Attorney, Agent, or Firm*—Fitzpatrick, Cella, Harper & Scinto

(57) ABSTRACT

A content (an amount of ink to be suctioned, or the number of times ink is preliminarily ejected) of the maintenance process to be performed after the ink tank replacement is made different depending on the amount of ink so far consumed from a tank which is replaced. This makes it possible to check the color mixture which would otherwise occur after the new ink tank is attached to the printing apparatus, and to concurrently manage an amount of waste ink in order that ink should not be consumed more than necessary in a case where the color mixture is less likely to occur.

5 Claims, 15 Drawing Sheets

INK JET PRINTING APPARATUS AND METHOD OF PERFORMING A MAINTENANCE PROCESS

BACKGROUND OF THE INVENTION

1. Field of the Invention

The present invention relates to an ink jet printing apparatus. Particularly, the present invention relates to a method of performing a process for maintaining a color ink jet printing head capable of making a print with multiple color inks for the purpose of keeping the color ink jet printing head capable of ejecting the inks stably.

2. Description of the Related Art

Ink jet printing apparatuses eject liquids such as inks to a printing medium from their ink jet printing heads depending on inputted image data, and thus print multiple dots on a printing medium, thereby forming the image thereon. A common practice for ink jet printing apparatuses each with such a configuration is that a maintenance process (hereinafter also referred to as a "recovery operation") is applied to their printing heads for the purpose of keeping their ink ejecting conditions adequate.

The maintenance process consists of a suction recovery process, a preliminary ejection process, a wiping process and the like. The suction recovery process is that which discharges inks from individual ejection openings forcedly by generating a negative pressure inside a cap by use of pumping means such as a tube pump and a piston pump while a face of a printing head, in which the ejection openings are arranged, is covered with the cap. This suction recovery process makes it possible to remove thickened inks and bubbles in printing head ink chambers, which adversely affect its ejection operation, from the interior of the head.

In the preliminary ejection process, an ejection operation is preliminarily carried out in order for inks to be stably ejected from the individual ejection openings. Particularly, in a case of a printing head which has just undergone the suction recovery process, it is likely that part of inks once discharged into the cap by the forced suction may flow back to the insides of the individual ejection openings. In other words, part of the thickened inks returns to the insides of the ink chamber and the nozzles in the printing head. In a case where the face in the printing head which ejects multiple color inks is configured to be covered with a single cap, ink mixed up by multiple color inks in the cap flows back into the insides of nozzles assigned for the respective color inks. With these problems taken into consideration, a common practice performed after carrying out the suction recovery process is to preliminarily eject multiple color inks from the individual ejection opening toward the inside of the cap while the inside of the cap is caused to communicates with the atmosphere for the purpose of discharging the thickened inks and the mixed ink. For example, the preliminary ejection is carried out approximately 20000 times with an ejection frequency of 10 kHz for each nozzle assigned for a corresponding one of the multiple color inks. It does not matter how many times the preliminary ejection should be carried out with what driving frequency, as long as the number of times and the frequency are enough for discharging the thickened inks and the mixed ink which flow back into the individual nozzles.

The wiping process is that to be carried out for the purpose of wiping inks, which adhere to the surface of the printing head in conjunction with the suction recovery process, the preliminary process and regular printing operations, off the surface by use of a wiping member.

As described above, as long as the suction recovery process, the preliminary ejection process and the wiping process are carried out at adequate timings before, during and after each printing operation, it is possible to keep the ejecting operation of the printing head in a stable condition.

Inks are consumed for the suction recovery process and the preliminary ejection process, which have been described above, regardless of actual printing operations. For the purpose of cutting back on running costs, it is desirable that amounts of inks consumed for these processes should be held as small as possible. In particular, large amounts of inks are often suctioned for the suction recovery process to be carried out when replacing old ink tanks with new ones from a viewpoint of stabilizing the ejecting operation. A key point for cutting back on running costs is to hold the amounts of suctioned inks and the amounts of preliminarily ejected inks as small as possible.

Japanese Patent Laid-Open No. 07-17058 (1995) discloses a method of making amounts of suctioned inks different between the suction recovery process to be carried out for ink tank replacement and the suction recovery process to be carried out for the purpose of doing things other than the ink tank replacement. In addition, Japanese Patent Laid-Open No. 2003-291368 discloses a process for avoiding carrying out the suctioning operation both before and after ink tank replacement. Furthermore, Japanese Patent Laid-Open No. 2005-306013 discloses a method of making an amount of suctioned ink different according to ink type (ink color) in an ink jet printing apparatus which simultaneously applies a suction recovery process to a printing head for ejecting multiple color inks by use of a single cap. Moreover, Japanese Patent Laid-Open No. 2004-98626 discloses an effective preliminary ejecting method to be carried out after a suction recovery process of an ink jet printing head which has a nozzle row for printing larger dots and a nozzle row for printing smaller dots for each type of ink.

After gradually decreasing inks in the respective ink tanks depending on use, the ink jet printing apparatus finally becomes capable of carrying out no printing operation. For the purpose of avoiding a situation in which a printing operation can be carried out no longer suddenly in the middle of making a print on a sheet of paper, many of ink jet printing apparatuses of a regular type include means for estimating amounts of remaining inks on a basis of how many times the printing head has ejected and been suctioned, and inform their users that an ink remains in a very small amount when the amount of the remaining ink becomes very small, thus urging the users to replace the old tank with a new one. However, the old ink tank is not necessarily replaced with the new one immediately when their users are informed that the amount of the remaining ink is very small. Even though the users are informed that the amount of the remaining ink is very small, they are likely to continue the printing operation for a while, in a case where the number of sheets of paper on which a print remains yet to be made is very small, or in a case where no new ink tank with which the old ink tank is replaced is on hand.

In this respect, let us discuss how the pressure inside an ink tank changes after the ink tank becomes nearly empty of its ink. First of all, in a case of an ink tank whose inside can communicate with the atmosphere, as the ink in the ink tank is discharged therefrom in conjunction with an ejection operation, the air is suctioned into the ink tank, and an air path is thus formed in the ink tank. In other words, the inside of the ink tank can maintain an atmospheric pressure equal to that of the external air. On the other hand, in a case of an air-tight ink tank whose inside can not communicate with the atmosphere, the negative pressure in the tank increases rapidly after an amount of ink remaining in the tank becomes very small. Subsequently, when the value representing the negative pressure goes beyond the meniscus pressure (that is, a pressure which ink in the vicinity of a nozzle in a printing head can withstand for forming a meniscus due to mutual attraction between the capillary force of the nozzle and the negative pressure in the ink tank), the ink starts to flow back. In recent years, not only atmosphere-communicating ink tanks each containing an ink in an absorber such as a sponge but also air-tight ink tanks each are capable of containing an ink in the form of a liquid are supplied in.

In the case of an air-tight ink tank, once inks flow back as described above when a suction recovery process is carried out, mixed ink, which has been present in the cap, flows into the individual nozzles, and is thus introduced to the insides of the common ink chamber and ink supplying ports in the printing head, and as far as to the insides of the ink tanks. Furthermore, if old ink tanks are replaced with new ones while the mixed ink remains in the insides of the common ink chamber, ink supplying ports and the like, it is likely that part of the mixed ink remaining in vicinities of the ink supplying ports with which to connect the printing head and the ink tank may likely enter the new ink tank with which the old ones are replaced.

SUMMARY OF THE INVENTION

The present invention has been made with the foregoing problems taken into consideration. An object of the invention is to restrains a color ink mixture occurring after ink tank replacement, or to solve a color ink mixture with discharging necessity minimum ink.

In a first aspect of the present invention, there is provided an ink jet printing apparatus for printing an image on a printing medium by using a printing head including an ejection opening for ejecting ink, comprising: an obtaining unit which obtains a value representing an amount of ink consumed from an ink tank which is replaceably connected to the printing head for the purpose of supplying the ink to the printing head; and a maintenance unit which performs a maintenance process on the printing head, wherein, in a case where the ink tank is replaced with a new one, a content of the maintenance process to be performed after the ink tank replacement is made different depending on the obtained value representing the amount of ink consumed from the ink tank which is replaced with the new one.

In a second aspect of the present invention, there is provided a method of performing a maintenance process for an ink jet printing apparatus for printing an image on a printing medium by using a printing head including an ejection opening for ejecting ink, comprising the steps of: obtaining a value representing an amount of ink consumed from an ink tank which is replaceably connected to the printing head for the purpose of supplying the ink to the printing head; and performing a maintenance process on the printing head, wherein, in a case where the ink tank is replaced with a new one, the maintenance process is made different depending on the obtained value representing the amount of ink consumed from the ink tank which is replaced with the new one.

In a third aspect of the present invention, there is provided an ink jet printing apparatus for printing an image on a printing medium by using a printing head including an ejection opening for ejecting ink, comprising: an obtaining unit which obtains a value representing an amount of ink consumed from an ink tank in which the negative pressure is becomes larger as the amount of ink to be consumed increases for supplying the ink to the printing head; a determining unit which determines whether the value representing the amount of ink consumed which obtained by the obtaining unit is larger than a threshold value or not; a suction unit which performs a suction operation to suction ink from the printing head; and a control unit which controls the suction unit to or not to perform the suction operation on the basis of a determination by the determining unit wherein, (i) in a case where the obtained value representing the amount of ink consumed is smaller than the threshold value, the control unit controls the suction unit so that the suction operation is performed, and (ii) in a case where the obtained value representing the amount of ink consumed is not smaller than the threshold value, the control unit controls the suction unit so that the suction operation is not performed.

Further features of the present invention will become apparent from the following description of exemplary embodiments (with reference to the attached drawings).

DESCRIPTION OF THE EMBODIMENTS

Descriptions will be provided next for embodiments of the present invention with reference to the drawings.

1. Basic Configuration 1.1 Configuration of Mechanism Units

Descriptions will be provided for configurations of the respective mechanism units in a printing apparatus to which the present embodiment is applied. The main body of the printing apparatus according to the present embodiment can be roughly divided into a sheet feeding unit, a sheet conveying unit, a sheet discharging unit, a carriage unit and a cleaning unit on a basis of roles which these units respectively play. These units are housed in an external housing.

Next, descriptions will be sequentially provided for the mechanism units according to the present invention with reference to their corresponding drawings.

(A) Carriage Unit (see FIGS. 1 to 3, and FIG. 7)

The carriage unit includes a carriage M4000 to which a printing head H1001 is attached. The carriage M4000 is supported by a guide shaft M4020 and a guide rail M1011. The guide shaft 4020 is attached to a chassis M1010. The guide shaft M4020 guides and supports the carriage M4000 in a way that causes the carriage M4000 to scan reciprocatingly in a direction (X-axis direction) orthogonal to a direction (Y-axis direction) in which a printing medium is conveyed. The guide rail M1011 is formed as a unit integrated with the chassis M1010. The guide rail M1011 holds the rear end of the carriage M4000, and plays a role in maintaining the clearance between the printing head H1001 and the printing medium. In addition, a sliding sheet M4030 made of a stainless steel thin plate or the like is provided, in a stretching manner, at a side of the guide rail M1011 over which the carriage M4000 slides, and thus aims at reducing sliding noises from the printing apparatus.

The carriage M4000 is driven via a timing belt M4041 by a carriage motor E0001 attached to the chassis M1010. In addition, the timing belt M4041 is stretched and supported by an idle pulley M4042. Moreover, the timing belt M4041 is connected to the carriage M4000 via a carriage damper made of rubber of the like, and the damping of vibrations of the carriage motor E0001 and the like thus reduces unevenness and the like in a printed image.

Figure 7:
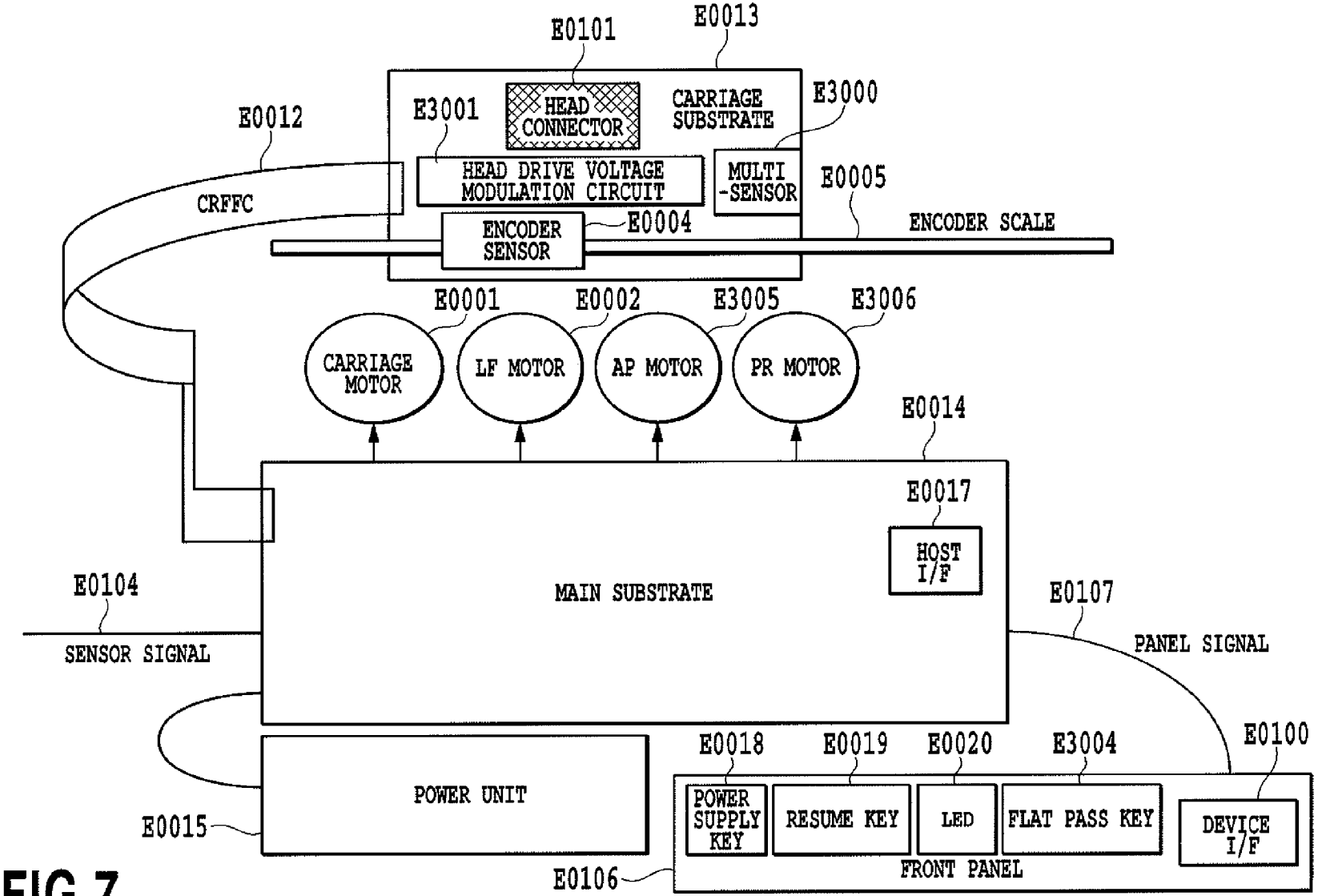
FIG. 7 is a block diagram schematically illustrating an overall configuration of an electric circuit in the printing apparatus.

As shown in FIG. 7, an encoder scale E0005 for detecting the position of the carriage M4000 is provided in parallel with the timing belt M4041. Markings are formed with a pitch of 150 lines per inch to 300 lines per inch on the encoder scale E0005. Moreover, an encoder sensor E0004 for reading the markings is provided to a carriage substrate E0013 mounted on the carriage M4000. The carriage substrate E0013 is provided with a head connector E0101 with which to electrically connect the carriage substrate E0013 to the printing head H1001. Furthermore, a flexible cable E0012 for transmitting a drive signal from an electric substrate E0014 to the printing head H1001 is connected to the carriage M4000.

As a configuration for fixing the printing head H1001 to the carriage M4000, the following members are provided on the carriage M4000. Specifically, a press alignment part for positioning the printing head H1001 to the carriage M4000 while pressing the printing head H1001 against the carriage M4000 and press means for fixing the printing head H1001 in a predetermined position in the carriage M4000 are provided on the carriage M4000, although neither the press alignment part nor the press means is illustrated there. The press means is mounted on a head set lever M4010, and is thus configured to works on the printing head H1001 while revolving the head set lever M4010 around its revolving axis when the printing head H1001 is set in the carriage M4000.

In addition, a position detecting sensor M4090 configured of a reflection optical sensor is attached to the carriage M4000. The position detecting sensor M4090 is used in a case where a printing is made on a special medium such as a CD-R, and in a case where a result of the printing, an end portion of sheet of paper, and the like are detected. The position detecting sensor M4090 is capable of detecting the current position of the carriage M4000 by emitting a beam of light from its light emitting device and receiving a reflected beam of light.

In a case where an image is formed on a printing medium by use of the foregoing configuration, the printing medium is put in a proper vertical position by causing the printing medium to be conveyed by paired rollers which are a conveyance roller M3060 and a pinch roller M3070. In addition, the printing medium is put in a proper horizontal position by causing the carriage motor E0001 to move the carriage M4000 in a direction perpendicular to a direction in which the printing medium is conveyed, and by accordingly arranging the printing head H1001 in an intended image forming position. The printing head H1001 thus positioned ejects inks to the printing medium in accordance with a signal from the electric substrate H1014. Descriptions will be provided later for a detailed configuration of the printing head H1001 and printing system. The printing apparatus according to the present embodiment performs a printing main scan and sub-scan alternately. The main scan is that in which the carriage M4000 scans in the horizontal direction while a print is being made by the printing head H1001. The sub-scan is that in which a printing medium is conveyed in the vertical direction by the conveyance roller 3060. By performing the main scan and sub-scan alternately, an image is formed on the printing medium.

Figure 1:
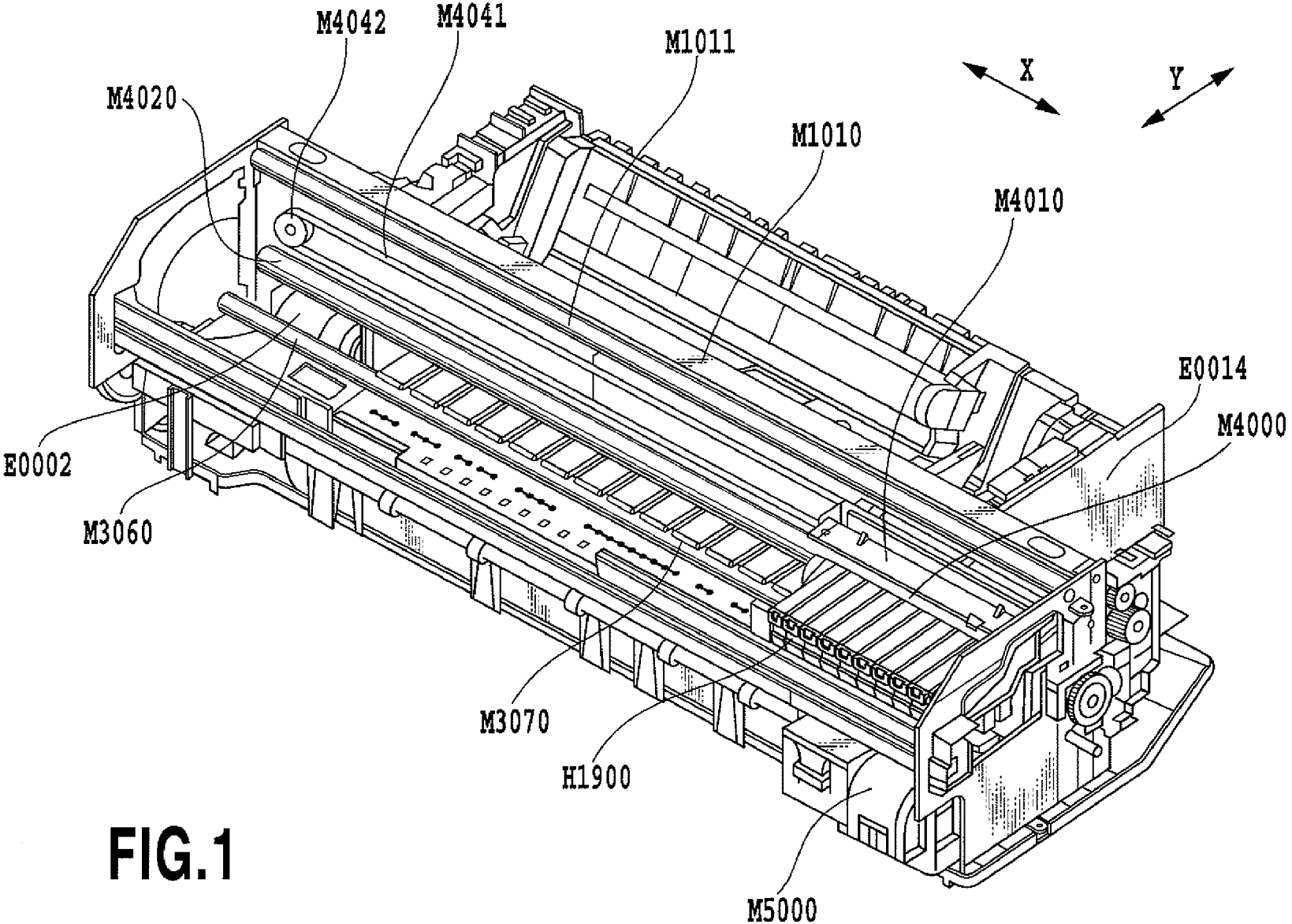
FIG. 1 is a perspective view illustrating a schematic configuration of an ink jet printing apparatus to which the present invention is applicable.
Figure 2:
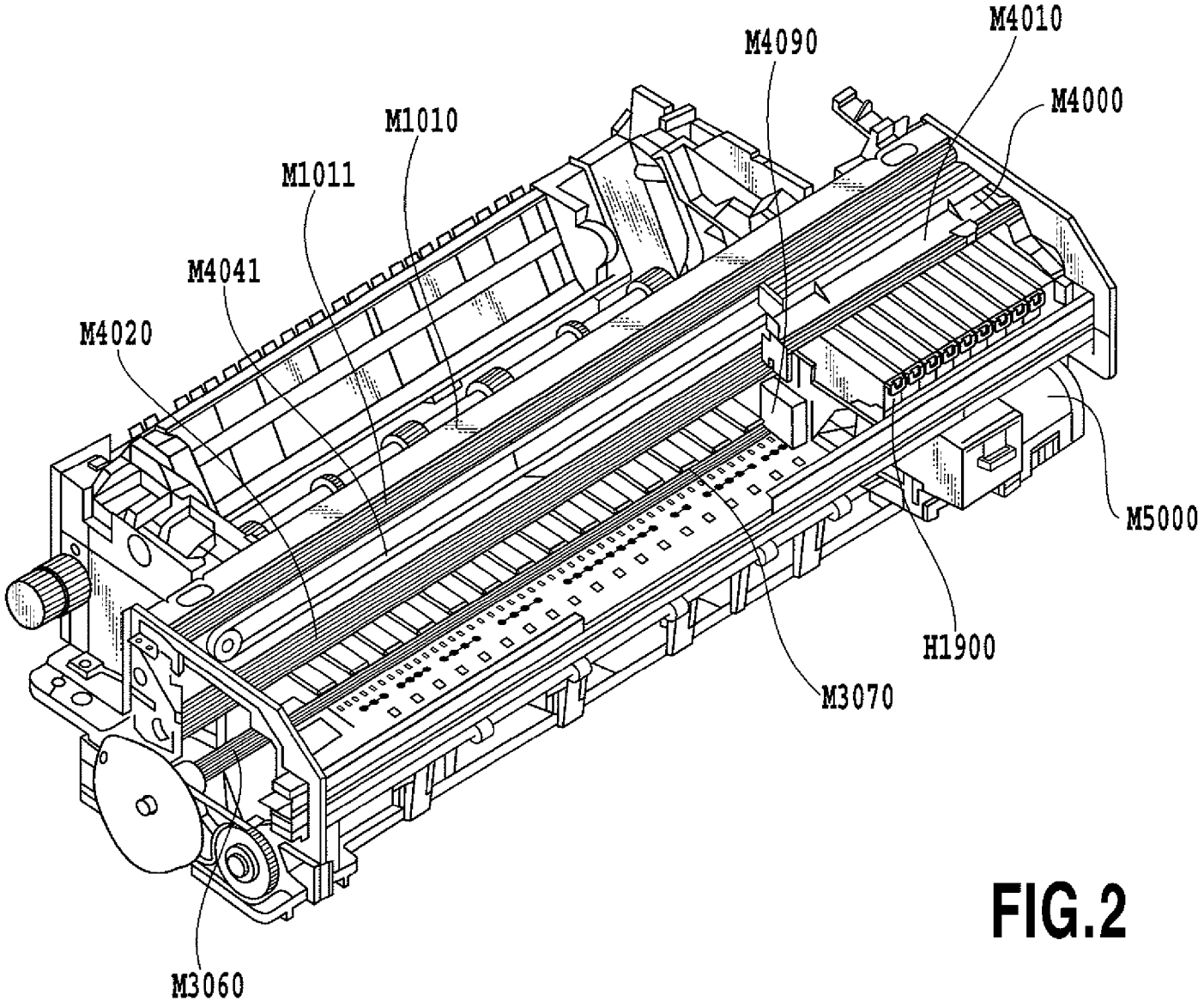
FIG. 2 is another perspective view illustrating the schematic configuration of the ink jet printing apparatus to which the present invention is applicable.
Figure 3:
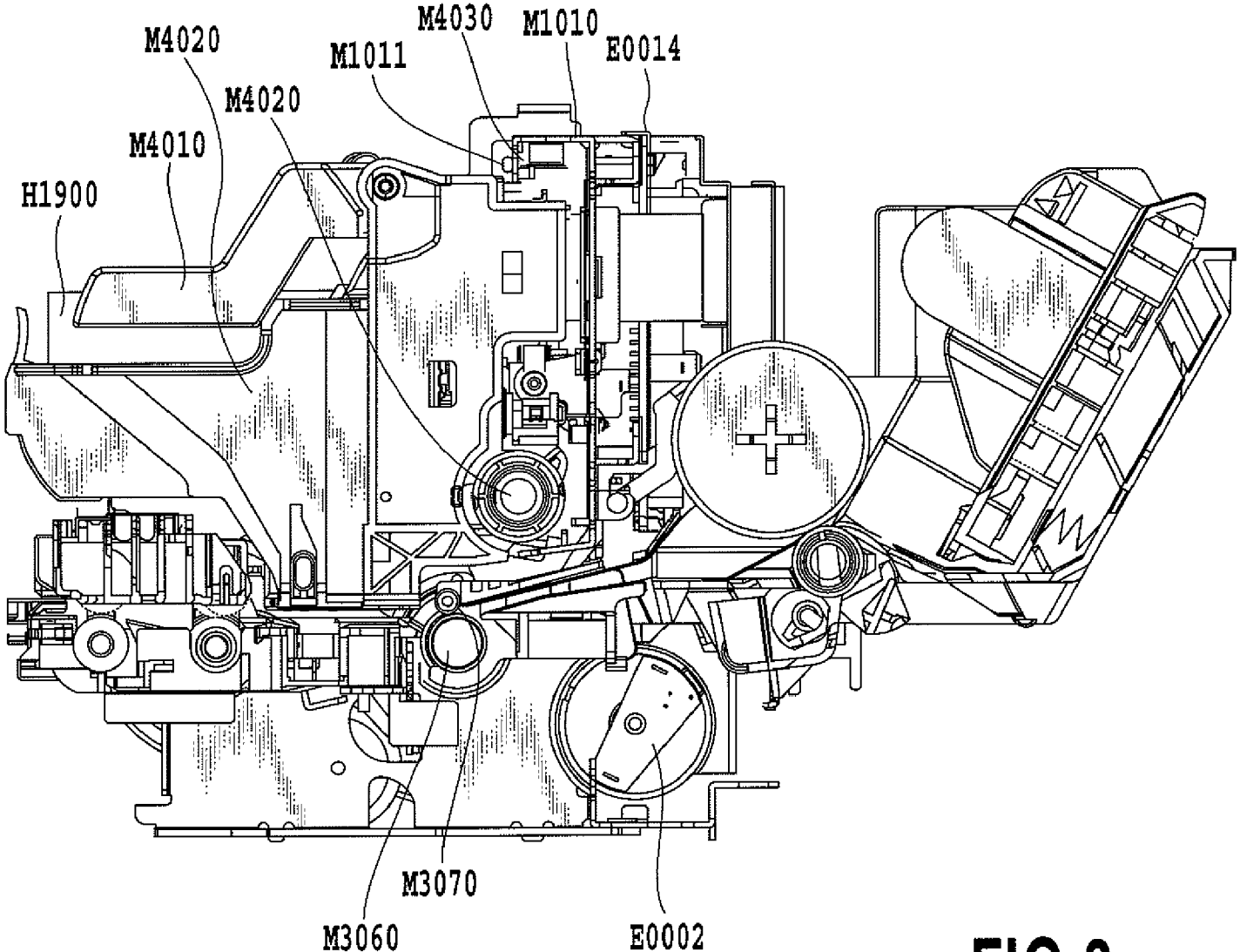
FIG. 3 is a side, cross-sectional view illustrating the schematic configuration of the ink jet printing apparatus to which the present invention is applicable.
Figure 4:
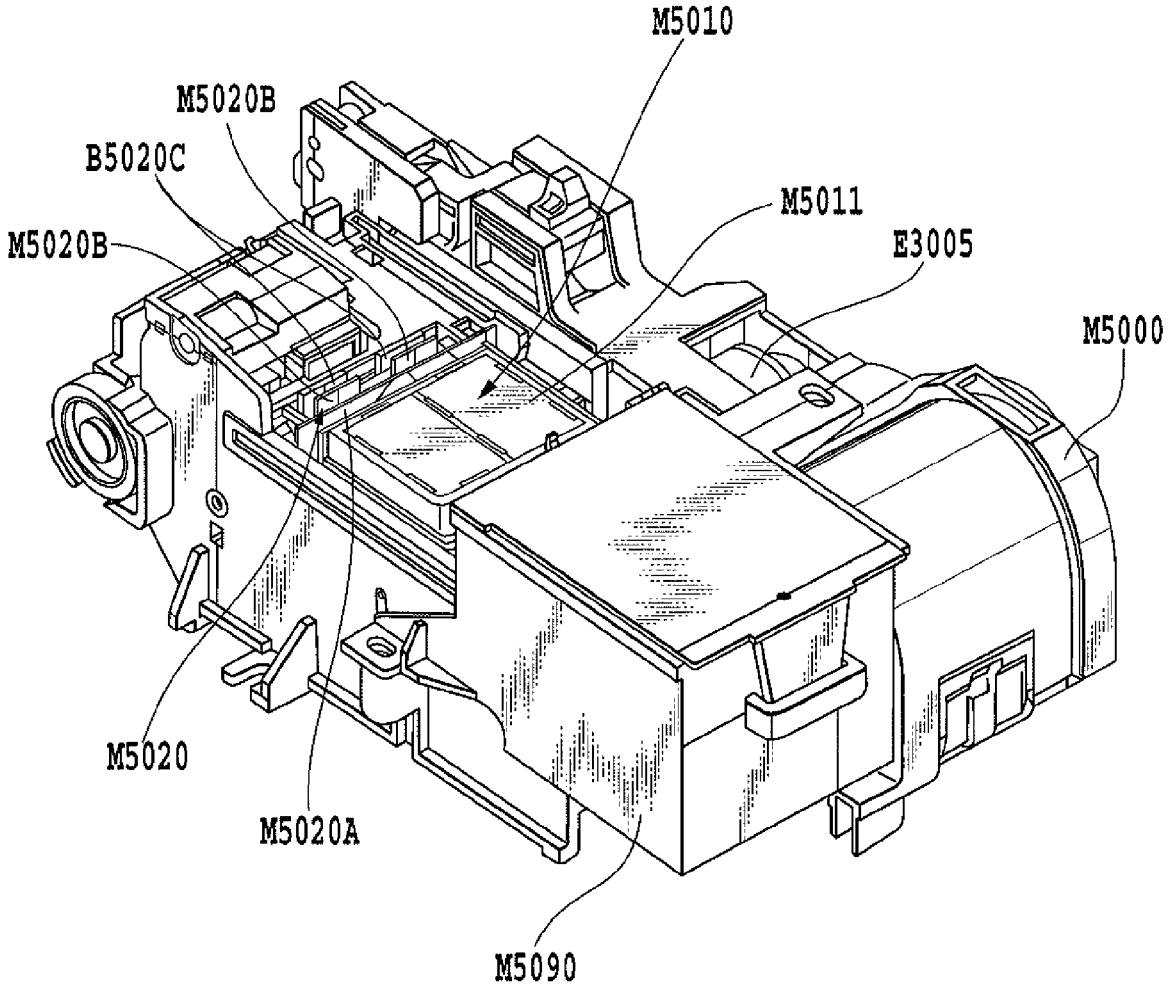
FIG. 4 is a cross-sectional view illustrating a schematic configuration of a cleaning unit in the ink jet printing apparatus to which the present invention is applicable.
Figure 5:
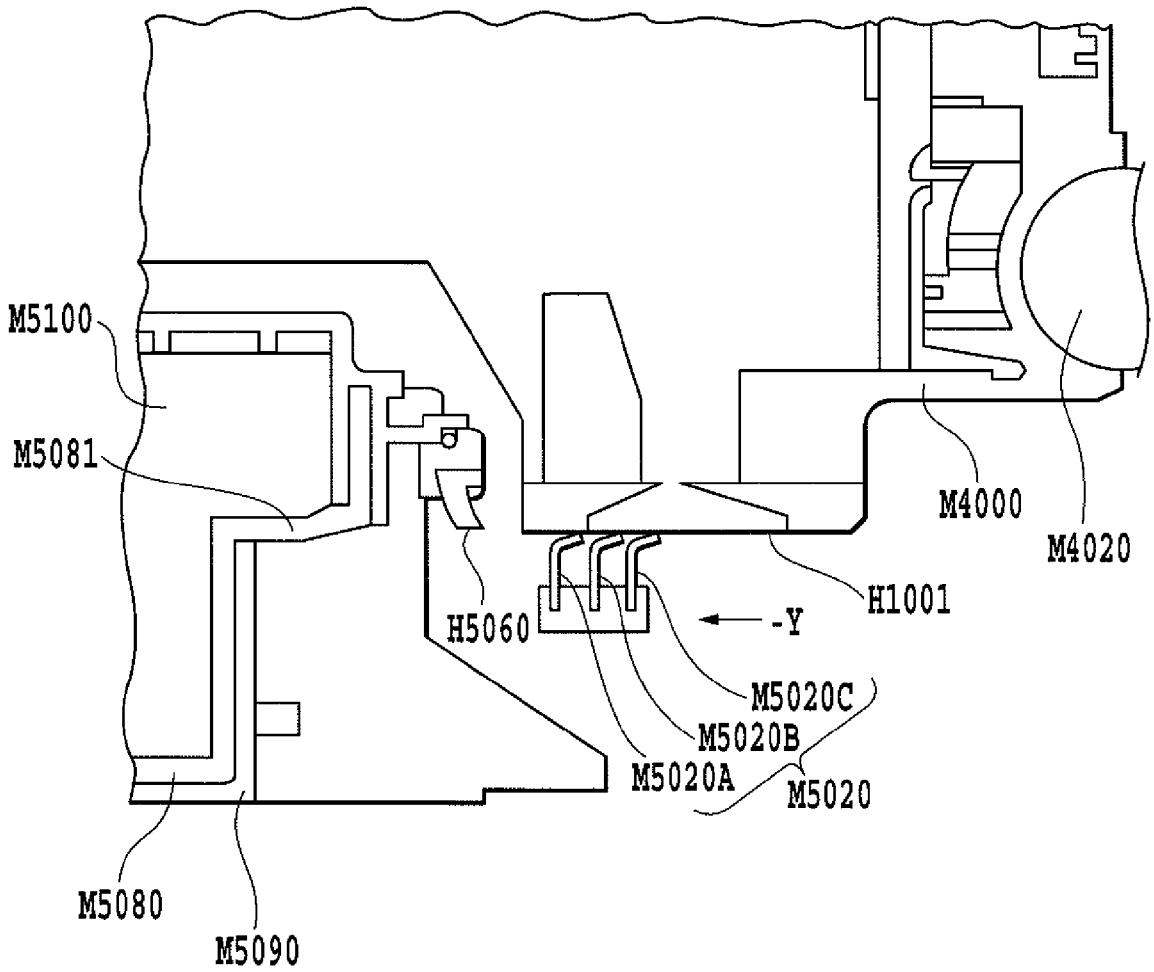
FIG. 5 is another cross-sectional view illustrating the schematic configuration of the cleaning unit in the ink jet printing apparatus to which the present invention is applicable.
Figure 6:
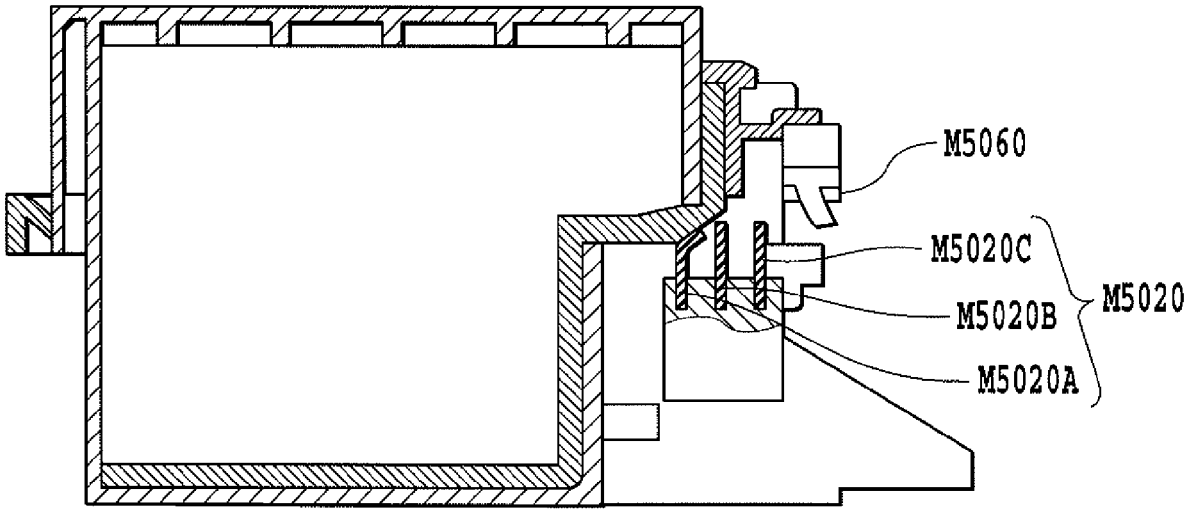
FIG. 6 is yet another cross-sectional view illustrating the schematic configuration of the cleaning unit in the ink jet printing apparatus to which the present invention is applicable.

(B) Cleaning Unit (See FIGS. 4 to 6)

The cleaning unit is a mechanism for applying a maintenance process (recovery process) to the printing head H1001. The cleaning unit is configured of: a pump M5000; a cap M5010 for preventing the printing head H1001 from getting dry; a wiper section M5020 for cleaning an ejection openings forming surface of the printing head H1001; and the like.

In the case of the present embodiment, a force for driving the cleaning unit is transmitted chiefly from an AP motor E3005. Although not illustrated, a one-way clutch operates the pump M5000 by its rotation in one direction. Thus, amounts of suctioned inks are controlled on a basis of the rotational amount of the one-way clutch. In addition, three types of blades M5020A to M5020C provided to the wiper section M5020 are designed to move, and the cap M5010 is designed to be lifted up and down, on a basis of the rotation of the one-way clutch in the other direction. It should be noted that, although the AP motor E3005 according to the present embodiment is used as not only the force for driving the cleaning unit but also a driving force source for an operation of feeding the printing medium, a motor specialized for operating the cleaning unit may be provided to the cleaning unit.

The cap M5010 is driven ascendably and descendably by the AP motor E3005 via an elevating mechanism, although not illustrated. When in an elevated position, the cap M5010 caps (shields) each several faces of the respective ejection sections provided in the printing head H1001. Thereby, the cap M5010 is capable of protecting the faces while no printing operation is being carried out, or of performing a forced suction recovery operation. While a printing operation is being carried out, the cap M5010 is set in a descending position which causes the cap M5010 to avoid contacting the printing head H1001. In addition, the cap M5010 is capable of receiving ink droplets which are ejected from the printing head H1001 for a preliminary ejection operation. The printing head H1001 according to the present embodiment is provided with 10 ejection rows capable of ejecting the 10 respective types of inks. The cap M5010 is configured of two parallel caps in order that 5 ejection sections are capped by each of the two parallel caps at one time.

As shown in FIG. 5, the three types of blades M5020A to M5020C each made of an elastic member such as a rubber are arranged in the wiper section M5020. Reference numeral M5020A denotes a blade for wiping the entire faces of the printing head H1001 including all of the ejection sections. Reference numerals M5020B and M5020C each denote two blades which correspond to two halves of the cap M5010, and each of which wipes the faces of its corresponding 5 ejection sections. These blades M5020A to M5020C are fixed to a wiper holder M5030. These blades are capable of performing a wiping operation or escaping in conjunction with the movement of the wiper holder M5030 in directions indicated by +Y and −Y in FIG. 5 (equivalent to a direction in which the ejection ports are arranged in each of the ejection sections).

When the printing head H1001 arrives at a home position, that is, a position which enables a maintenance process to be performed by the cleaning unit, the wiper holder M5030 moves in a direction indicated by the arrow −Y, and a wiping process is thus applied to the face. Once the wiping process is completed, the carriage M4000 is caused to escape to an outside of the area which enables the wiping process to be performed. Thereafter, the three blades M5020A to M5020C are returned to a position in which the blades do not contact the face and the like.

After the wiping process, the wiper holder M5030 further moves in the direction indicated by −Y. This causes the three blades M5020A to M5020C to abut on a blade cleaner M5060, by which inks and the like adhered to the blades M5020A to M5020C are removed therefrom.

A suction pump 5000 is capable of generating a negative pressure inside the cap M5010 while an air-tight space is formed by connecting the cap M5010 to the faces. Thereby, inks are suctioned from their respective ink tanks H1900 connected to the printing head H1001. This makes it possible to fill the nozzles with their respective inks, and to suction and thus remove dust, adhering matter, bubbles and the like present in the ejection openings or the ink paths inward of the ink ejection openings.

For example, a tube pump type of suction pump is used as the suction pump M5000. The suction pump M5000 may be a pump which includes: a member in which a curved surface is formed, and which holds a flexible tube by causing at least a part of the flexible tube to run along its curved surface; a roller capable of pressing the flexible tube against the curved surface; and a rotatable roller supporting part for supporting this roller. Specifically, when the roller supporting part is caused to rotate in a predetermined direction, the roller rotates and moves while squeezing the flexible tube on the curved-surface forming member. In conjunction with this, the negative pressure is generated in the air-tight space which is formed by the cap M5010, and inks are accordingly suctioned via their respective ejection openings. As a result, the inks are drawn up into the tube or the suction pump from the cap M5010. Subsequently, the inks in the process of being drawn up thereto are further transferred to a member (waste ink absorbent), which is provided to a lower case of the main body of the apparatus.

It should be noted that an absorbent M5011 is provided inside the cap M5010 for the purpose of reducing amounts of inks remaining in their corresponding faces of the printing head H1001 after the suction process. In addition, inks remaining inside the cap M5010 and the absorbent M5011 are suctioned therefrom while the cap M5010 is left open. Thereby, consideration is made in order that the remaining inks should not adhere thereto, and in order that problems should not subsequently occur due to the adherence of the remaining inks thereto. In this respect, it is desirable that an abrupt negative pressure should not work on the faces by providing an atmosphere communicating valve (although not illustrated) in the middle of an ink suctioning path, and by leaving this valve before the cap M5010 is detached from the faces.

Furthermore, the suction pump M5000 is capable of being operated for not only the suction recovery process but also a process of discharging inks which have been received in the cap M5010 during a preliminary ejection operation to be carried out with the cap M5010 placed opposite to the faces. Specifically, if the suction pump M5000 is operated when inks which have been held in the cap M5010 through a preliminary ejection process reach a predetermined amount, this operation makes it possible to transfer the inks held in the cap M5010 to the waste ink absorbent via the tube.

The series of the foregoing operations, including the operation of the wiper section M5020 and the lifting up and down of the cap M5010, which are carried out successionally, are controllable by use of a main cam which is provided on an output shaft of the AP motor E3005, multiple cams driven coupled with the main cam, an arm and the like, although not illustrated. In other words, on the basis of the rotational movement of the main cam depending on a direction in which the AP motor E3005 rotates, the cam section, the arm and the like are operated in each of the units. This makes it possible to carry out predetermined operations. The position of the main cam is capable of being detected by use of the position detecting sensor such as a photo-interrupter.

1.2 Configuration of Electric Circuit

Descriptions will be provided next for a configuration of an electric circuit in the ink jet printing apparatus according to the present embodiment.

FIG. 7 is a block diagram schematically illustrating an overall configuration of the electric circuit in the printing apparatus. In the case of the printing apparatus to which the present embodiment is applied, the electric circuit is configured chiefly of a carriage substrate E0013, a main substrate E0014, a power supply unit E0015 and a front panel E0106 and the like.

In this circuit, the power supply unit E0015 is connected to the main substrate E0014, and supplies various driving powers.

The carriage substrate E0013 is a print substrate unit mounted on the carriage M4000. The carriage substrate E0013 functions as an interface for exchanging signals with the printing head H1001 via the head connector E0101, and for supplying a head driving power to the printing head H1001 via the head connector E0101. The carriage substrate E0013 includes a head driving voltage modulating circuit E3001 as a part dedicated for controlling the head driving power supply, and the head driving voltage modulating circuit E3001 has multiple channels to the respective sections of ejecting inks in the printing head H1001. As a result, the carriage substrate E0013 generates a head driving power supply voltage on the basis of conditions specified by the main substrate E0014 via a flexible flat cable (CRFFC) E0012. In addition, the carriage substrate E0013 detects a change in the positional relationship between the encoder scale E0005 and the encoder sensor E0004 on the basis of pulse signals outputted from the encoder sensor E0004 in conjunction with the movement of the carriage M4000. Furthermore, the carriage substrate E0013 outputs the output signals to the main substrate E0014 via the flexible flat cable (CRFFC) E0012.

Figure 9:
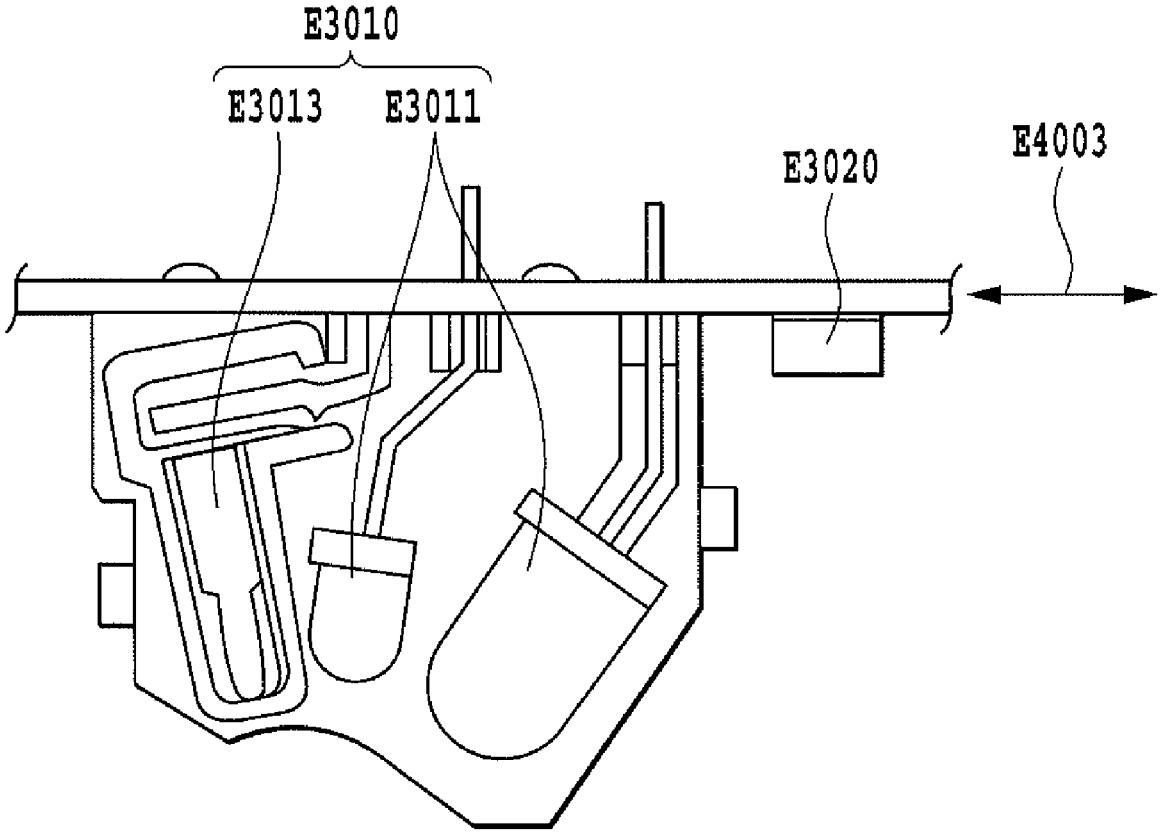
FIG. 9 is a diagram illustrating a schematic configuration of a multi-sensor.

As shown in FIG. 9, an optical sensor E3010 and a thermistor E3020 are connected to the carriage substrate E0013. The optical sensor E3010 is configured of two light emitting devices (LEDs) E3011 and a light receiving device E3013. The thermistor E3020 is that for detecting its ambient temperature. These sensors will be hereinafter referred to as a "multi-sensor E3000." Information acquired by the multi-sensor E3000 is outputted to the main substrate E0014 via the flexible flat cable (CRFFC) E0012.

The main substrate E0014 is a print substrate unit for controlling the drives respectively of the units in the ink jet printing apparatus according to the present embodiment. The main substrate E0014 includes a host interface (host I/F) E0017 on itself, and controls the printing operations on the basis of data received from a host computer, although not illustrated. In addition, the main substrate E0014 is connected to various motors, including the carriage motor E0001, an LF motor E0002, the AP motor E3005 and a PR motor E3006, and thus controls the drives respectively of their functions. The carriage motor E0001 is a motor serving as a driving power source for causing the carriage M4000 to perform main scans. The LF motor E0002 is a motor serving as a driving power source for conveying printing medium. The AP motor E3005 is a motor serving as a driving power source for carrying out an operation of recovering the printing head H1001 and an operation of feeding the printing medium. Furthermore, the main substrate E0014 is connected to a sensor signal E0104 for sending a control signal to, and receiving a detection signal from, various sensors for detecting the operating conditions of the respective units in the printing apparatus. In this respect, the various sensors include a PE sensor, a CR lift sensor, an LF encoder sensor and a PG sensor. Moreover, the main substrate E0014 is connected to the CRFFC E0012 and the power supply unit E0015, and includes an interface for exchanging information with the front panel E0106 via a panel signal E0107.

The front panel E0106 is a unit provided in the front of the main body of the printing apparatus for users' convenience. The front panel E0106 includes a resume key E0019, an LED E0020, a power supply key E0018 and a flat pass key E3004, and further include a device I/F E0100 used for connecting the printing apparatus to a peripheral device such as a digital camera.

Figure 8:
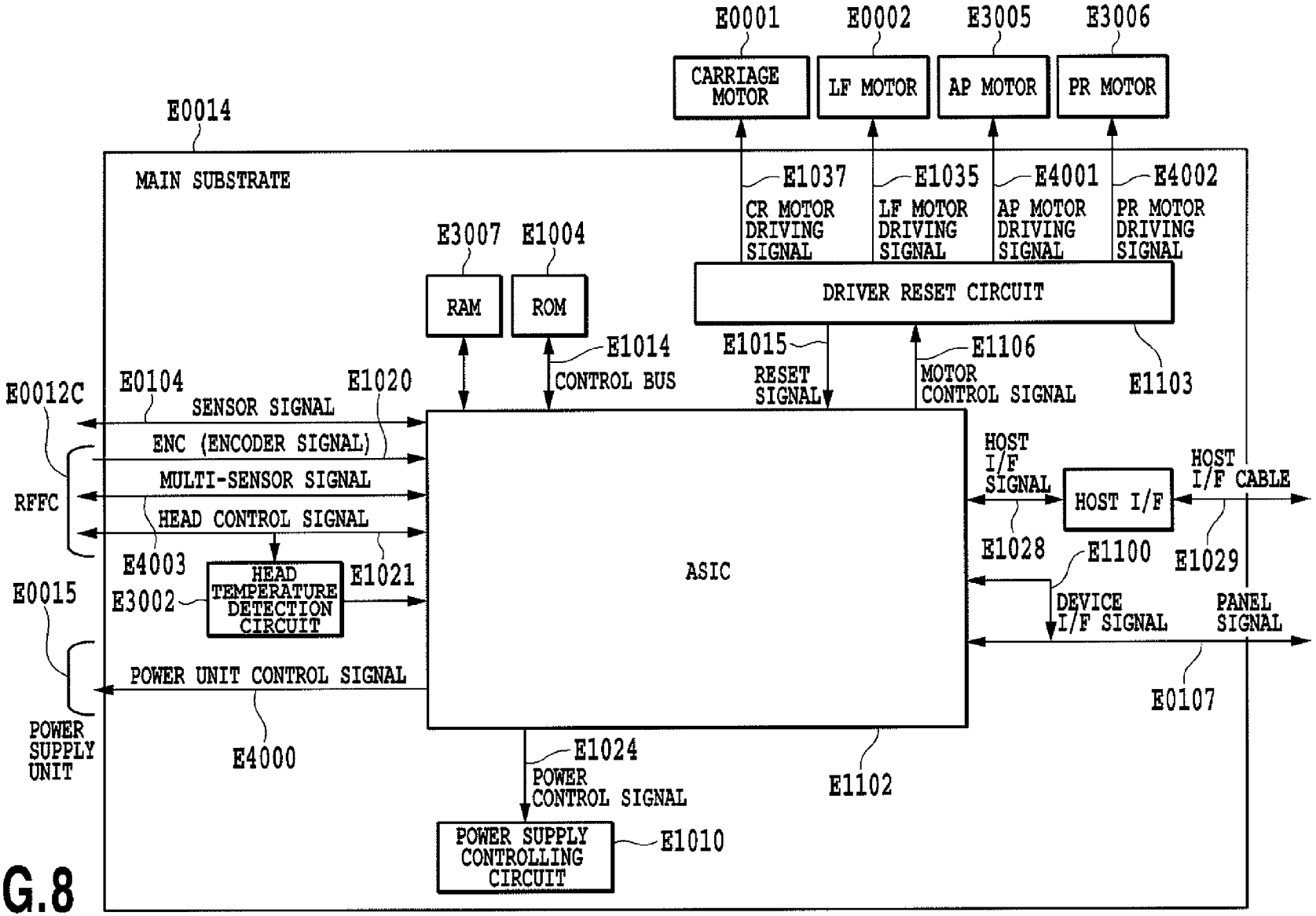
FIG. 8 is a block diagram illustrating an inner configuration of a main substrate E1004.

FIG. 8 is a block diagram showing an internal configuration of the main substrate E1004.

In FIG. 8, reference numeral E1102 denotes an ASIC (Application-specific Integrated Circuit), which is connected to a ROM E1004 via a control bus E1014, and which thus performs various controls on the main body of the printing apparatus on the basis of programs stored in the ROM E1004. For example, the ASIC E1102 transmits and receives a sensor signal E0104 concerning each of the various sensors, and a multi-sensor signal E4003 concerning the multi-sensor E3000. In addition, the ASIC E1102 detects an encoder signal E1020 as well as conditions of outputs respectively from the power supply key E0018, the resume key E0019 and the flat pass key E3004. Additionally, the ASIC E1102 performs various logical operations and various conditional judgments depending on its connection to the host I/F E0017 and the device I/F E0100 on the front panel as well as conditions of data inputs. Thereby, the ASIC E1102 controls each of the components, and thus controls the drive of the ink jet printing apparatus.

Reference numeral E1103 denotes a driver reset circuit. On the basis of a motor controlling signal E1106 from the ASIC E1102, the driver reset circuit E1103 generates a CR motor driving signal E1037, an LF motor driving signal E1035 and an AP motor driving signal E4001, and thus drives these motors. Adjustment of amounts of suctioned inks, which is characteristic of the present embodiment, is controlled by the ASIC E1102 by use of the AP motor controlling signal E4001 as well. In addition, the driver reset circuit E1103 includes a power supply circuit, and thus supplies necessary powers to the parts such as the main substrate E0014, the carriage substrate E0013 and the front panel E0106. Furthermore, the driver reset circuit E1103 detects a voltage drop of the power supply, and thus generates and initializes a reset signal E1015.

Reference numeral E1010 denotes a power supply controlling circuit, which controls the power supply to the sensors each including a light emitting device on the basis of a power supply controlling signal E1024 from the ASIC E1102.

Through a host I/F E0017, a host I/F signal E1028 from the ASIC E1102 is transmitted to a host I/F cable E1029 connected to the outside of the main substrate E0014, and a signal from this cable E1029 is transmitted to the ASIC E1102.

On the other hand, a power is supplied from the power supply unit E0015. The power thus supplied is supplied to the parts inside and outside the main substrate E0014 after its voltage is converted depending on the necessity. A power supply unit controlling signal E4000 from the ASIC E1102 is connected to the power supply unit E0015, and thus controls a low power consumption mode and the like of the main body of the printing apparatus.

The ASIC E1102 is a single-chip semiconductor integrated circuit including a built-in arithmetic processing unit, and outputs the motor controlling signal E1106, the power supply controlling signal E1024, the power supply unit controlling signal E4000 and the like. In addition, the ASIC E1102 exchanges signals with the host I/F E0017, and concurrently exchanges signals with the device I/F E0100 on the front panel via the panel signal E0107. Moreover, the ASIC E1102 detects the printing conditions with sensors in the respective sections, such as the PE sensor and an ASF sensor, through the sensor signal E0104. In addition, the ASIC E1102 controls the multi-sensor E3000 with the multi-sensor signal E4003, and concurrently detects conditions of the multi-sensor E3000. Additionally, the ASIC E1102 detects conditions of the panel signal E0107, and thus controls the drive of the panel signal E0107, hence flashing the LED E0020 on the front panel.

In addition, the ASIC E1102 detects conditions of the encoder signal (ENC) E1020, and thus generates a timing signal, hence controlling the printing operation by causing itself to be interfaced with the printing head H1001 through a head controlling signal E1021. In this respect, the encoder signal (ENC) E1020 is an output signal from the encoder sensor E0004, which signal is inputted into the ASIC E1102 via the CRFFC E0012. Furthermore, the head controlling signal E1021 is connected to the carriage substrate E0013 via the flexible flat cable E0012. Subsequently, the head controlling signal E1021 is supplied to the printing head H1001 via the head driving voltage modulating circuit E3001 and the head connector E0101. Concurrently, various pieces of information from the printing head H1001 are transmitted to the ASIC E1102. Among the various pieces of information, information on the head temperature of each of the ejection sections is used for various controls and various judgments by amplifying a signal representing the information by use of a head temperature detecting circuit E3002 on the main substrate, and by subsequently inputting the resultant signal into the ASIC E1102.

In FIG. 8, reference numeral E3007 denotes a DRAM, which is used as a buffer for data on a printing operation, data received from the host computer, and the like, as well as a work area needed for various controlling operations.

1.3 Configurations of Printing Head and Ink Tanks

Descriptions will be provided below for a configuration of the head cartridge H1000 to which the present embodiment is applied.

The head cartridge H1000 according to the present embodiment includes the printing head H1001, means for mounting the ink tanks H1900 on the head cartridge H1000, and means for supplying inks from the respective ink tanks H1900 to the printing head. The head cartridge H1000 is detachably mounted on the carriage M4000.

Figure 10:
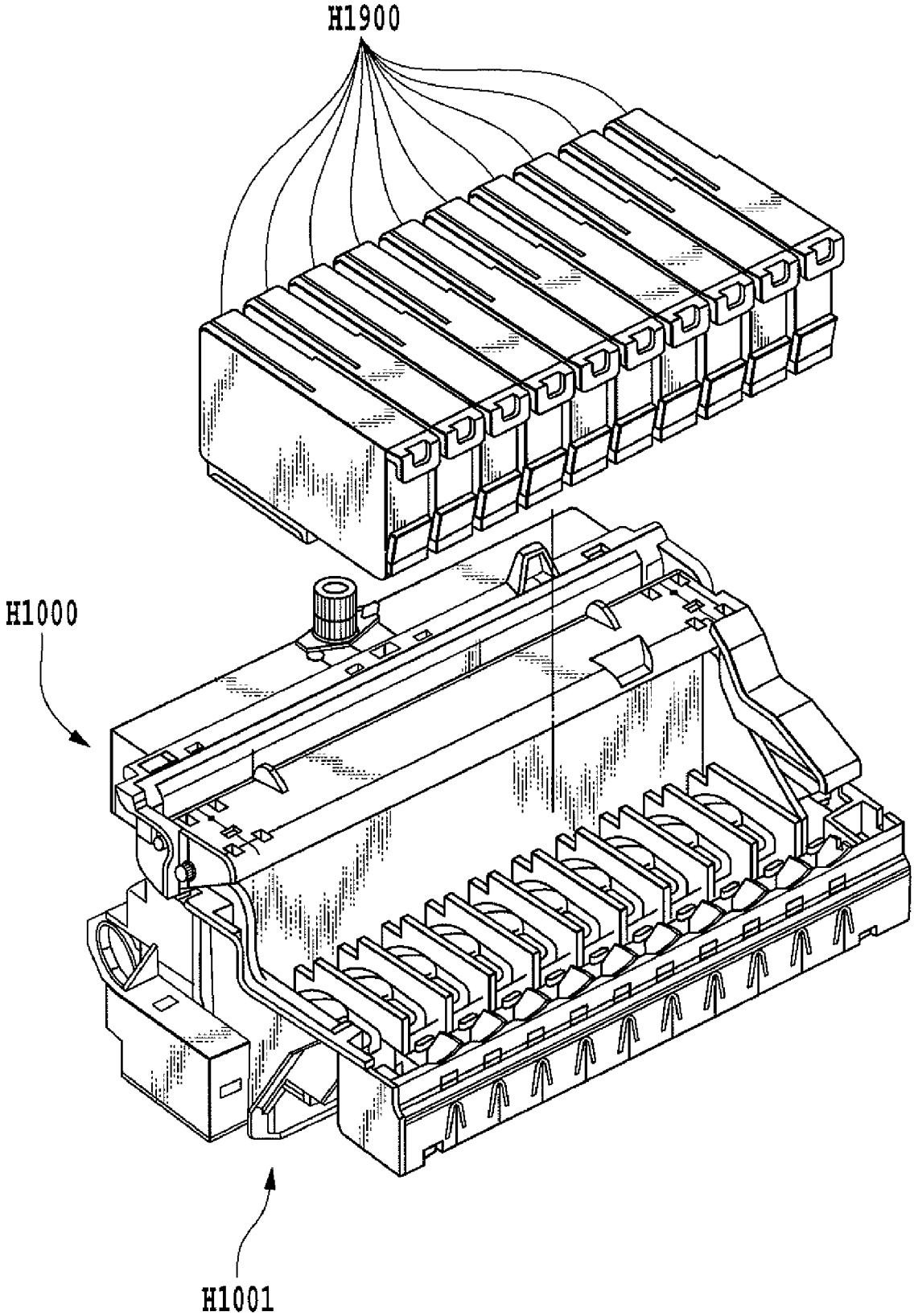
FIG. 10 is a diagram illustrating how ink tanks are attached to a head cartridge.

FIG. 10 is a diagram showing how the air-tight ink tanks H1900 are attached to the head cartridge H1000 to which the present embodiment is applied. The printing apparatus according to the present embodiment forms an image by use of 10 pigmented inks representing their respective colors. The 10 colors are cyan (c), light cyan (Lc), magenta (M), light magenta (Lm), yellow (Y), a first black (K1), a second black (K2), red (R), green (G) and gray (Gray). For this reason, 10 ink tanks H1900 are assigned to the 10 respective colors. As shown in FIG. 10, each of the ink tanks H1900 is designed to be capable of being attached to, and detached from, the head cartridge H1000 in order that the ink tanks H1900 may be replaceable. It should be noted that the ink tanks H1900 are designed to be capable of being attached to, and detached from, the head cartridge H1000 even while the head cartridge H1000 is mounted on the carriage M4000.

2. Characteristic Configurations

Detailed descriptions will be provided below for characteristics of the embodiment of the present invention.

Figure 11:
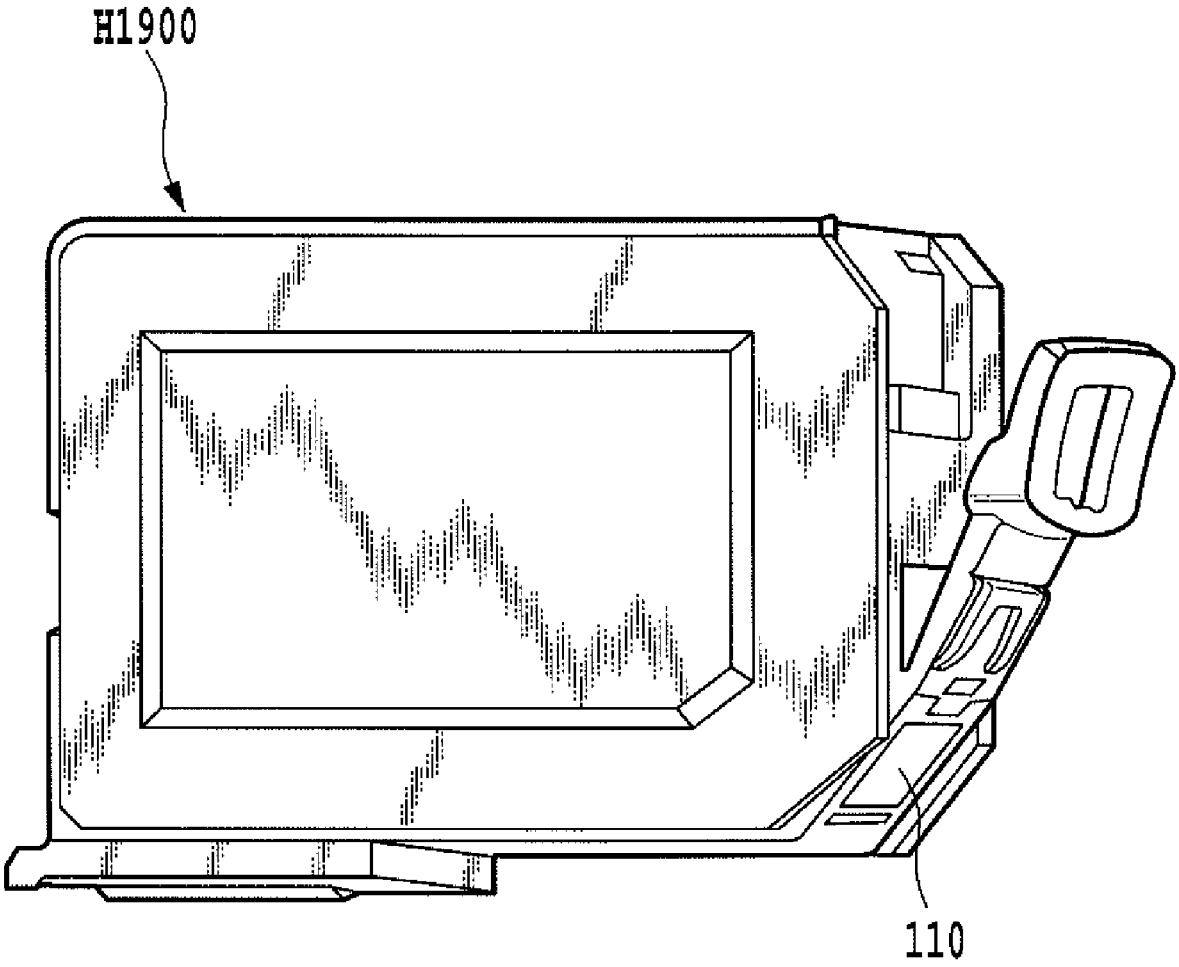
FIG. 11 is a perspective view illustrating a schematic configuration of one of the ink tanks which are used for an embodiment of the present invention.

FIG. 11 is a perspective view illustrating a schematic configuration of one of the ink tanks H1900 which are used for the present embodiment. The external surface of the ink tank H1900 is provided with a memory section 110 including: a memory chip which information is capable of being written in, and read from; and a connection terminal of the memory chip (although neither the memory chip nor the connection terminal is illustrated). The connection terminal of the memory section 110 is electrically connected to the head connector E0101 in the carriage substrate E0013 which has been described by use of FIG. 7 by attaching the ink tank H1900 to the head cartridge H1000. A value representing the amount of ink poured into the ink tank H1900 and several threshold values are stored in the memory chip when the ink tank H1900 is manufactured. The threshold values are those used for comparing with the amount of consumed ink which increases in conjunction with its use. Information on the amount of ink which has been consumed through subsequent printing operations and maintenance operations is noticed to the memory chip from the main body of the printing apparatus via the connection terminal. Thus, data stored in the memory chip is updated depending on the necessity.

Figure 12:
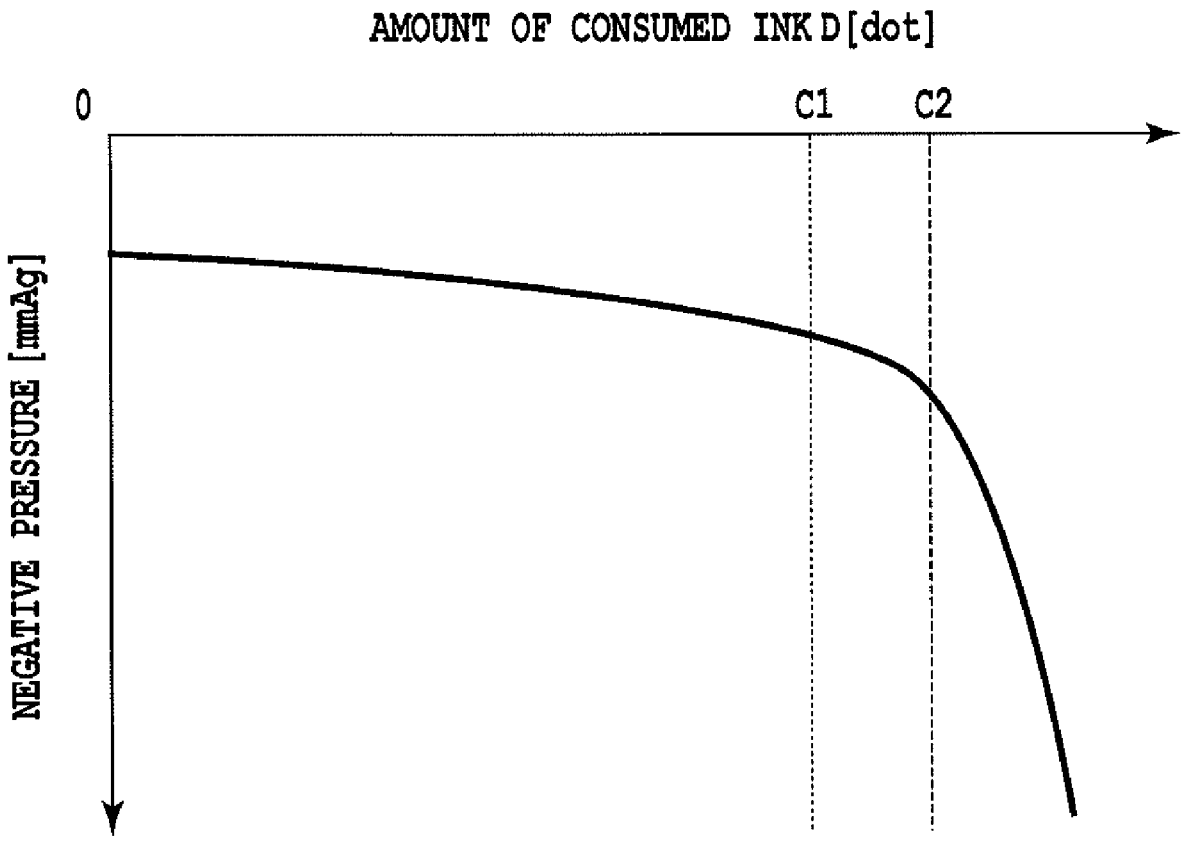
FIG. 12 is a diagram illustrating a relationship between an amount D (dots) of ink consumed and a negative pressure in a tank, which relationship is observed while the ink continues being consumed.

Here, the gross amount of ink is defined as an amount of ink which is poured into the ink tank H1900 when the ink tank is manufactured, whereas the net amount of ink is defined as an amount of ink which is capable of being eventually consumed from the ink tank H1900. The gross amount of the ink is not equal to the net amount of the ink. This is because some part of the ink poured into the ink tank can not be consumed due to its adherence to, and its remaining on, the internal wall and inner corners in the ink tank. The amount of ink which can not be consumed will be hereinafter referred to as an "amount of dead ink." The 10 ink tanks H1900 containing the respective 10 color inks according to the present embodiment have a single configuration. For this reason, amounts of dead inks eventually remaining in the respective ink tanks can be regarded as virtually equal to one another even though the types of inks contained in the ink tanks are different from one to another. It should be noted, however, that the gross amount of the ink poured into the ink tank when the ink tank is manufactured is inevitably different from one tank to another. In addition, the amount of ink droplets ejected for one ejection operation is different from one color to another due to the design-attributable variation in the amounts of ejected ink droplets among the colors, and due to variation in the dimensions of the corresponding nozzles, which occurs when the nozzles are manufactured. For this reason, in the case of the present embodiment, a value obtained by allowing a margin for a value obtained by dividing the "net amount" of the ink as a designed value by the amount of ejected ink for each of the colors, that is to say, a value by allowing the margin for the initially-expected the number of times ejection operations are capable of being carried out, is stored in the memory chip as a threshold value C1 of the amount of ink to be consumed, in the memory section 110 when the ink tank is manufactured. For example, when the amount of ink ejected for each ejection operation is 5.0 ng and a conservatively-estimated "net amount" plus a margin is 14.0 g, the threshold value C1 is 2,800,000,000 dots obtained by dividing 14.0 g by 5.0 ng. After an ink tank H1900 for each of the colors is attached to the printing head cartridge H1000, the main body of the printing apparatus counts the number of times of ejection operation repeatedly, and thus updates the amount of ink which has been consumed (or dot count number) for each color which is stored in the memory chips. This makes it possible to acquire the amount of ink consumed from each of the ink tanks H1900 in a virtually real-time manner. On the other hand, in a case of ink consumption for a suction recovery process or the like, a predetermined amount of ink suctioned for each suction process or the like is divided by the amount of ink ejected for each ejection operation for each color to which an ink tank is assigned, and thereby a converted value corresponding to the number of ejecting times is acquired. Subsequently, the converted value is added to the amount of ink which has been so far consumed for each color FIG. 12 is a diagram illustrating a relationship between an amount of ink so far consumed D (dot) stored in the memory and a negative pressure inside an ink tank H1900, which is observed when ink continues to be consumed in a particular amount per unit time with the ink tank H1900 attached to the head cartridge H1000.

The ink tank H1900 to which the present embodiment is applied has no means for causing the ink tank to communicate with the atmosphere. For this reason, as the ink inside the ink tank continues to be consumed, the negative pressure inside the ink tank becomes gradually larger. The ink continues to be consumed steadily until the amount of ink so far consumed reaches the threshold value C1 obtained by allowing the margin for the value obtained by dividing the "net amount" by the amount of ink ejected for each ejection operation. As a result, the negative pressure changes moderately. In the case of the ink jet printing apparatus according to the present embodiment, the ASIC E1102 compares the updated amount of ink so far consumed, which is stored in the memory chip, with the threshold value C1 depending on the necessity. When the amount of ink so far consumed becomes equal to, or larger than, the threshold value (C1), the printing apparatus informs a user that the ink runs out (or that the amount of remaining ink is very small). It should be noted that C1 is the value obtained by allowing the margin for the initially-expected "net amount." For this reason, even after the amount of ink so far consumed becomes equal to, or larger than, the threshold value, the ink tank is capable of supplying ink to the printing head H1001 steadily to some extent though the negative pressure increases moderately. In FIG. 12, C2 denotes a value corresponding to the real "net amount" which includes an amount of ink corresponding to the "margin." After the amount D of ink so far consumed exceeds C2, the negative pressure inside the ink tank increases rapidly. If the ink tank is not replaces with a new one regardless, the printing head is no longer capable of ejecting the ink due to the rapidly increasing negative pressure.

For example, if the user instructs the printing apparatus to carry out a suction recovery operation regardless of this situation, a far larger negative pressure occurs inside the tank. As a result, immediately after the suction pump M5000 completes its operation, inks representing the respective colors which have been discharged and mixed up in the cap M5010 by the suction operation are flowed back to each printing head due to the larger negative pressure inside the tank. It is likely that, as a result of this back flow, the mixed ink may flow into the ink paths and ink chambers in the printing head, and as far as into the ink supplying ports as connection parts between the printing head and the ink tanks H1900 as well as the insides of the ink tanks H1900. If any one of the ink tanks is replaced with a new one regardless of this condition, the mixed ink which remain in the ink supplying port and its vicinity enter into the new ink tank, too. To put it the other way round, there is a concern that an image to be printed immediately after the ink tank replacement has a color tone which is remarkably different from its original color tone.

With this taken into consideration, in the case of the present embodiment, the amount of ink to be suctioned for a suction recovery operation carried out for the first time after an ink tank replacement is set to be large enough for the mixed ink, which exists in the ink supplying port and its vicinity, to be discharged fully only when it is likely that the old ink tank has been replaced with the new one while the mixed ink is include there. Specifically, in a case where the old ink tank is replaced with the new one after the amount of ink so far consumed exceeds the threshold C2, the amount of ink to be suctioned immediately after the ink tank replacement is set at a larger value. In a case where the old ink tank is replaced with the new one before the amount of ink so far consumed exceeds the threshold value C2, the amount of ink to be suctioned immediately after the ink tank replacement is set at a smaller value. This makes it possible to solve the ink mixture condition with discharging necessity minimum of ink for the recovery operation.

Figure 13:
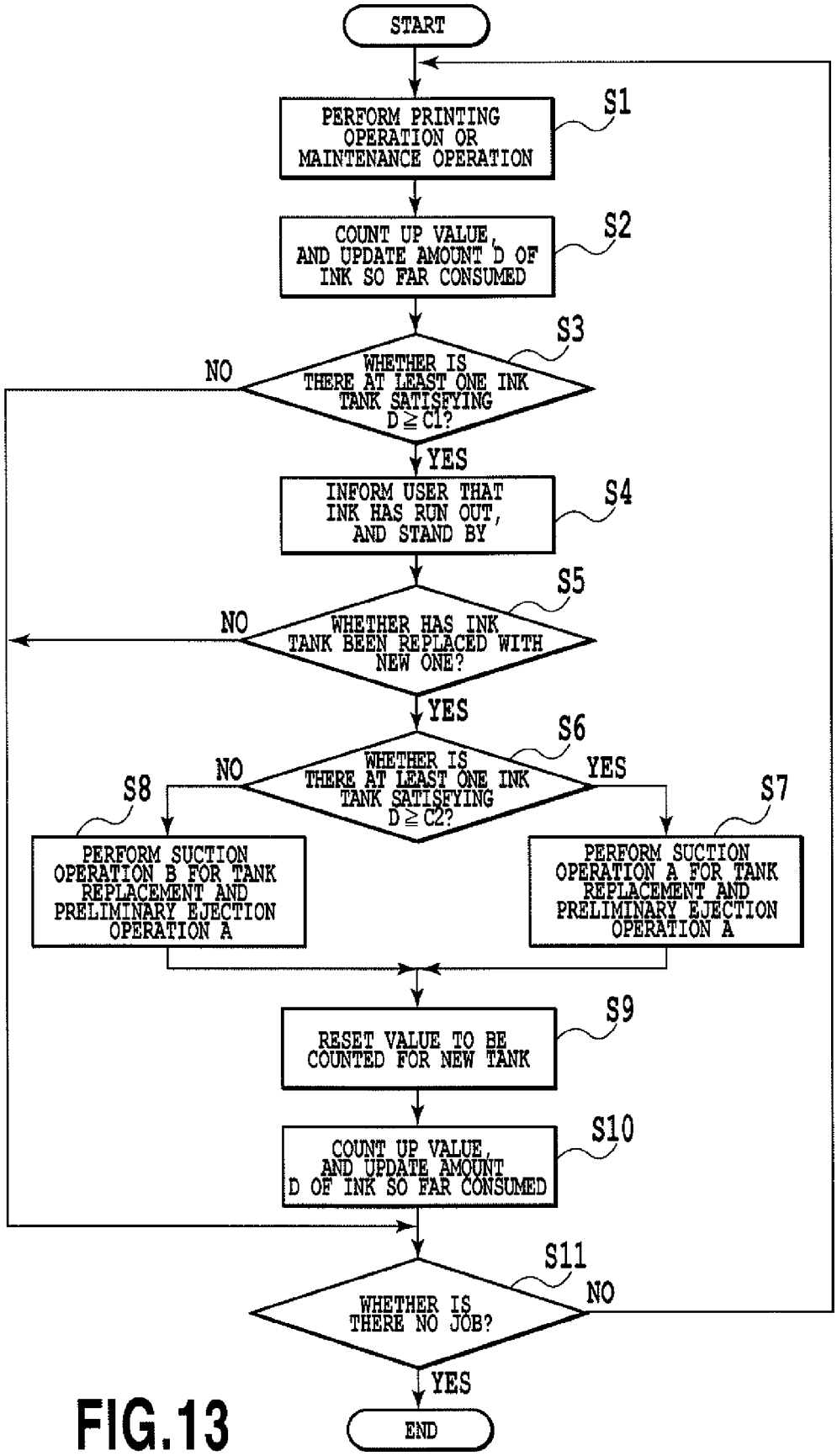
FIG. 13 is a flowchart illustrating an ink tank replacement sequence to be controlled by an ASIC (Application-specific Integrated Circuit) according to a first embodiment.

FIG. 13 is a flowchart illustrating an ink tank replacement sequence to be controlled by the ASIC E1102 according to the present embodiment.

Once a command concerning a job such as a printing operation or a maintenance operation is inputted by use of the host I/F E0017 or the device I/F E0100, the ASIC E1102 operates each unit to perform a job designated by step S1, that is to say, the printing operation or the maintenance process. In step S2, the ASIC E1102 counts up the amount of ink consumed for performance of the job in step S1 by dot unit for each of the ink colors, and updates the amount D of ink so far consumed which is stored in the memory chip in the ink tank assigned for the ink color. A value representing the amount of ink so far consumed is acquired for each ink tank in this manner.

In step S3, the ASIC E1102 compares the amount D of ink so far consumed with the first threshold value C1 beforehand stored in the memory chip 110 for each ink tank. If D<C1 in all of the ink tanks, the ASIC E1102 determines that no tank needs to be replaced with a new one, and jumps to step S11. On the other hand, if at least one of the ink tanks satisfies D≧C1, the ASIC E1102 proceeds to step S4.

In step S4, the ASIC E1102 informs a user of which ink tank has run out of ink. With regard to an ink tank of which the ASIC E1102 has already informed the user, the ASIC E1102 continues informing the user of the ink tank. Subsequently, the ASIC E1102 enters into a stand-by condition without doing anything else. The stand-by condition is released when the old ink tank is replaced with a new one, or when the user inputs a job continuation command. In the ensuing step S5, the ASIC E1102 determines whether or not the old ink tank, of which the ASIC E11102 has informed the user in step S4, is replaced with a new one. If the ASIC E1102 determines that the old ink tank has not been replaced with a new one yet, the ASIC E1102 proceeds to step S11 in order to deal with the next job.

On the other hand, if the ASIC E1102 determines that the old ink tank has been replaced with a new one, the ASIC E1102 proceeds to step S6, where the ASIC E1102 compares the amount D of ink so far consumed, which is acquired in step S2, with the second threshold value C2 which is a value larger than C1. Thereafter, if D<C2 in all of the ink tanks, the ASIC E1102 proceeds to step S8. If at least one of the ink tanks satisfies D≧C2, the ASIC E1102 proceeds to step S7. In step S7 or in step S8, the ASIC E1102 operates the cleaning unit to perform maintenance processes assigned for step S7 or step S8, respectively. Specifically, in step S7, the ASIC E1102 controls the AP motor E3005 which drives the cleaning unit to perform a suction operation A for the tank replacement and a preliminary ejection operation A. In step S8, the ASIC E1102 controls the AP motor E3005 which drives the cleaning unit to perform a suction operation B for the tank replacement and the preliminary ejection operation A. In this respect, the amount of ink to be suctioned for the suction operation A for the tank replacement is set at a value larger than the amount of ink to be suctioned for the suction operation B for the tank replacement, that is to say, an amount of ink to be suctioned which is large enough to discharge mixed ink which has flowed back from the ink supplying port to the inside of the new ink tank. In this manner, the present example pays attention to a fact that the amount of ink to be flowed back varies depending on how much ink has been consumed from the old ink tank which is replaced with the new one. Thereby, the present example makes different the content of (or the amount of ink to be suctioned for) the suction recovery process to be performed after the ink tank replacement depending on how much ink has been consumed from the old ink tank which is replaced with the new one. Specifically, when there is great possibility of ink mixture caused by flowing back of ink, a large amount of ink is suctioned for the suction recovery process. On the other hand, when there is a little possibility of ink mixture caused by flowing back of ink, a small amount of ink is suctioned for the suction recovery process. As a result, it is possible to solve the ink-mixed condition with discharging necessity minimum of ink for the recovery operation.

In the ensuing step S9, the ASIC E1102 resets the amount D of ink so far consumed for the newly-attached ink tank at zero. In the ensuing step S10, the ASIC E1102 counts up the amount of ink consumed in step S7 or step S8, and thus updates the amount D of ink so far consumed, for all of the ink tanks.

In step S11, the ASIC E1102 determines whether or not there remains a job which the ASIC E1102 should perform next. In a case where the ASIC E1102 determines that a job remains yet to be performed, the ASIC E1102 returns to step S1, where the ASIC E1102 performs the next job. In a case where the ASIC E1102 determines that no job remains yet to be performed at the present time, the ASIC E1102 completes this process.

In the case of the present embodiment, the two threshold values (C1 and C2) are setup depending on how strongly it is apprehended that colors are mixed up when the suction recovery process is performed, in order that the amount D of ink to be consumed, which increases as the ink continues being consumed, can be compared with the two threshold values. Thereby, the present embodiment makes different the amount of ink to be suctioned when the old ink tank is replaced with the new one depending on a result of comparing the amount D of ink to be consumed with each of the two threshold values. This makes it possible to check colors from being mixed up after the new tank is attached thereto, and to concurrently manage the amount of ink to be suctioned in order that the ink should not be consumed more than necessary in a case where it is not so much apprehended that the colors are mixed up.

Second Embodiment

Descriptions will be provided next for a second embodiment of the present invention. In the case of the present embodiment, the printing apparatus, head cartridge and ink tank according to the first embodiment are used as well.

Figure 14:
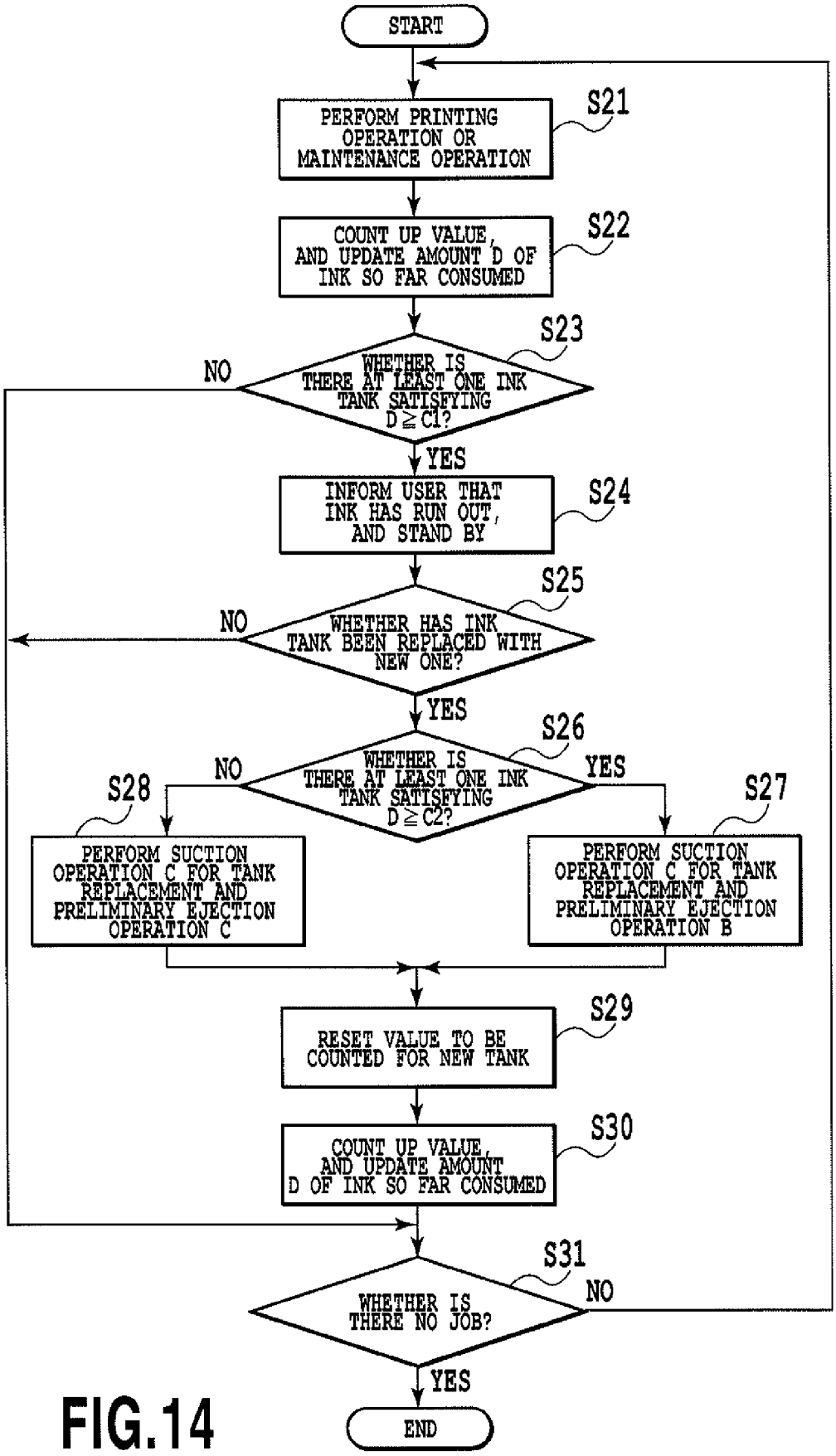
FIG. 14 is a flowchart illustrating an ink tank replacement sequence to be controlled by the ASIC according to a second embodiment.

FIG. 14 is a flowchart illustrating an ink tank replacement sequence to be controlled by the ASIC E1102 in the present embodiment. Almost all of the steps are the same as those carried out in the first embodiment. However, the second embodiment is different from the first embodiment with regard to a scheme of performing maintenance processes in steps S27 and S28. In the present embodiment, the ASIC E1102 operates the cleaning unit to perform a suction operation C for the ink tank replacement and a preliminary ejection operation B in step S27, and to perform the suction operation C for the ink tank replacement and a preliminary ejection operation C in step S28. In this respect, the number of ejecting times for the preliminary ejection operation B is set at a value larger than the number of ejecting times for the preliminary ejection operation C. As describe here, the present example makes different the content of (or the number of ejecting times for) the preliminary ejection process to be performed after the ink tank replacement, depending on how much ink has been so far consumed from the old ink tank which is replaced with a new one.

Like the first embodiment, the present embodiment makes it possible to manage the amount of waste ink in order that the ink should not be consumed more than necessary. It should be noted that the method of discharging mixed ink by adjusting the number of ejecting times according to the present embodiment makes it possible to perform finer adjustment than the method of discharging mixed ink by adjusting the amount of ink to be suctioned according to the first embodiment. In other words, the second embodiment makes it possible to hold the amount of ink to be discharged for the purpose of avoiding colors being mixed up as smallest as possible.

Third Embodiment

Descriptions will be provided next for a third embodiment of the present invention. In the case of the present embodiment, the printing apparatus, head cartridge and ink tank according to the first or second embodiment are used as well. The present embodiment characterized in that a suction recovery operation is restricted when there is a possibility of ink mixture, in order to avoid ink mixture itself. Specifically, although the ASIC received a command to perform a suction recovery operation, if there is an ink tank of which amount of ink so far consumed is larger than the threshold value C1, the ASIC restrict performing the suction recovery operation. This can prevent mixture ink in the cap from flowing back.

Figure 15:
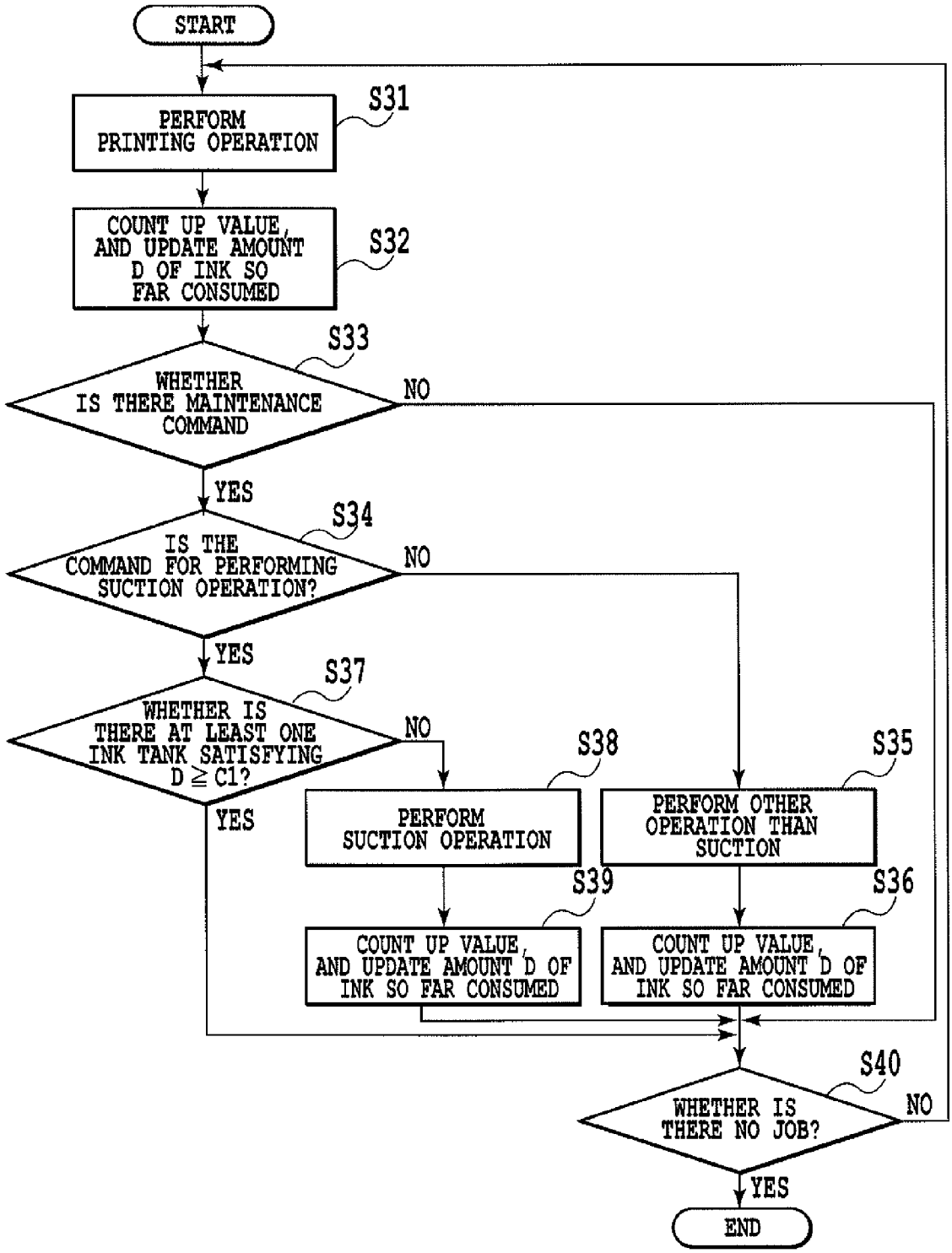
FIG. 15 is a flowchart illustrating a recovery process sequence to be controlled by the ASIC during a printing operation according to a third embodiment.

FIG. 15 is a flowchart illustrating a recovery process sequence to be controlled by the ASIC E1102 during printing operation in the present embodiment.

Once a command concerning a job such as a printing operation is inputted by use of the host I/F E0017 or the device I/F E0100, the ASIC E1102 operates each unit to perform a printing operation designated by step S31. In step S32, the ASIC E1102 counts up the amount of ink consumed for performance of the job in step S31 by dot unit for each of the ink colors, and updates the amount D of ink so far consumed which is stored in the memory chip in the ink tank assigned for the ink color.

In step S33, the ASIC E1102 determines whether a maintenance process is necessary or not, or determines whether a user has selected a maintenance process or not. In other words, the ASIC E1102 determines whether it has received a maintenance command or not. In a case where the ASIC E1102 determines that it has not received a maintenance command, the ASIC E1102 proceeds to step S40.

In step S40, the ASIC E1102 determines whether or not there remains a job which the ASIC E1102 should perform next. In a case where the ASIC E1102 determines that a job remains yet to be performed, the ASIC E1102 returns to step S31, where the ASIC E1102 performs the next job. In a case where the ASIC E1102 determines that no job remains yet to be performed at the present time, the ASIC E1102 completes this process.

On the other hand, in a case where the ASIC E1102 determines that it has received a maintenance command in step S33, the ASIC E1102 proceeds to Step S34. Then the ASIC E1102 determines whether the maintenance process is a suction recovery process or other process (e.g. preliminary ejection process or wiping process). In a case where the ASIC E1102 determines that the maintenance process is other than a suction recovery process, the ASIC E1102 proceeds to Step S35 to perform the maintenance process. Subsequently in Step S36, the ASIC E1102 counts up the amount of ink consumed in step S35 by dot unit for each of the ink colors.

On the other hand, in a case where the ASIC E1102 determines that the maintenance process is a suction recovery process in Step S34, the ASIC E1102 proceeds to Step S37. In Step S37, the ASIC E1102 compares the amount D of ink so far consumed with the first threshold value C1 beforehand stored in the memory chip 110 for each ink tank. If $D<C1$ in all of the ink tanks, the ASIC E1102 determines that a suction recovery operation is necessary, and jumps to step S38. In Step S38, the ASIC E1102 performs the suction recovery operation, and in Step S39, the ASIC E1102 counts up the amount of ink consumed in step S38 by dot unit for each of the ink colors.

On the other hand, if at least one of the ink tanks satisfies $D \geqq C1$ in Step S37, the ASIC E1102 proceeds to step S40 without performing the suction recovery operation. In other words, the ASIC E1102 restricts performing the suction recovery operation even if it received a command (in Step S34) for a suction recovery process. If the ASIC E1102 performs the suction recovery operation in this condition, a far larger negative pressure occurs inside the tank because the amount D of ink so far consumed is larger than the threshold value C1. Consequently, there is a concern that inks representing the respective colors which have been discharged and mixed up in the cap M5010 are flowed back to each printing head. It is likely that, as a result of this back flow, the mixed ink may flow into the ink supplying ports and the insides of the ink tanks. Therefore, in the present embodiment, when there is a possibility of ink mixture, ink mixture itself is avoided by restricting the suction recovery operation.

It should be noted that, in the present embodiment, a printing operation is not restricted although a suction recovery operation is restricted. This makes it possible for a user who wants to continue a printing operation to continue the printing operation without a suction recovery process. After a suction recovery operation has been restricted, a preliminary ejection operation before a printing operation or a maintenance operation (Step S35) other than the suction recovery operation after a printing operation is able to be performed. Consequently, a certain degree of stability of the ejecting operation is secured.

As described above, in the present embodiment, if there is an ink tank which is concerned about ink mixture by a suction recovery operation, a suction recovery operation is restricted for preventing ink mixture itself more steadily.

Other Embodiments

The first or the second embodiment controls the amount of ink to be discharged when an old ink tank is replaced with a new one by making different the amount of ink to be suctioned, or the number of times ink is preliminary ejected. Needless to say, however, the amount of ink to be discharged may be controlled by use of both the amount of ink to be suctioned and the number of times ink is preliminary ejected. In addition, if more threshold values are set up, this makes it possible to control the amount of waste ink in more finely graded steps. In this case, if a method of informing a user of the amount of ink so far consumed is different from one step to another, this makes it possible to cause the user to realize the condition in which the amount of ink so far consumed changes gradually in more detail. Furthermore, in the foregoing three embodiments of the first to third embodiment, the threshold values of each ink tanks may be different from each other.

The foregoing embodiments manage the amount D of ink so far consumed by substituting the amount D with the number of ejecting times (the number of dots). Needless to say, however, any parameter other than the number of dots and any other calculation method may be adopted as long as the parameter and calculation method reflect how much ink remains after consumed in response to the use. Furthermore, the printing head and ink tanks according to the present invention are not limited to the configuration as shown with regard to the foregoing embodiments, in which ink tanks are capable of being attached to, and detached from, the printing head. The present invention may be applied to a configuration in which the printing head and ink tanks are integrated into one unit and a configuration in which the printing head, carriage and ink tanks are integrated into one unit. In addition, the present invention is applicable to a configuration in which the printing head and carriage are integrated into one unit while inks are supplied to the printing head via the respective tubes or pipes from ink tanks provided in a location other than the integrated unit. Moreover, the number of inks used for the ink jet printing apparatus, that is to say, neither the number of ink tanks nor the number of printing heads is limited to the numbers shown for the foregoing embodiments.

The foregoing descriptions have been provided considering, as the chief problem to be solved, a problem that colors are likely to be mixed up in the case the multiple inks are simultaneously suctioned with the single cap. Nevertheless, the present invention is effective for a case where the multiple inks are suctioned with their respective caps. This is because, even in this case, if a large negative pressure occurs in the tank, air and foreign objects are taken into the printing head due to the back flow so that they adversely affect images to be printed subsequently.

In this respect, descriptions will be provided below for a case where a configuration in which the multiple caps provided for their respective inks (ink-to-cap configuration) is applied to the foregoing three embodiments. First, in a case where the ink-to-cap configuration is applied to the first or second embodiment, the amount of ink to be discharged for the recovery operation after an old ink tank is replaced, is made different depending on how much ink has been consumed from the old ink tank which is replaced, according to the first or second embodiment. This makes it possible to prevent degradation of image due to the back flow of mixed ink with discharging necessity minimum of ink. On the other hand, in a case where the ink-to-cap configuration is applied to the third embodiment, a suction recovery operation may be restricted for only ink tank which an amount of ink so far consumed from is larger than the threshold value C1. This makes it possible to prevent degradation due to the back flow of mixed ink.

It does not matter that, unlike the ink tanks according to the foregoing embodiments, the ink tanks are not necessarily provided with the storage means in which the amount D of remaining ink and the threshold values are stored. If the printing apparatus includes means in which information on the amount of ink remaining in each of the ink tanks mounted on the printing apparatus and the threshold values for each of the ink tanks are stored, and means for updating the information and the threshold values, it does not matter whether these means are provided to the main body of the apparatus or these means and each corresponding one of the ink tanks are integrated into one unit.

No matter what cases may be adopted, these cases fall within the scope of the present invention as long as a control is made in order that information on the amount of ink consumed from each of the ink tanks is acquired and the content (or the amount of discharged ink such as the amount of suctioned ink and the number of times ink is preliminary ejected) of a recovery process to be performed immediately after an ink tank replacement is made different depending on the information.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is a continuation application of PCT application No. PCT/JP2007/074462 under 37 Code of Federal Regulations §1.53 (b) and the said PCT application claims the benefit of Japanese Patent Application No. 2006-344634, filed Dec. 21, 2006, which is hereby incorporated by reference herein in its entirety.

What is claimed is:

1. An ink jet printing apparatus for printing an image on a printing medium by using a printing head including an ejection opening for ejecting ink and a replaceable ink tank which contains the ink for supply to the printing head, comprising:

a maintenance unit which performs a maintenance process for discharging the ink from the printing head;

a detector which detects a replacement of the ink tank;

an obtaining unit which obtains information representing an amount of ink consumed from the ink tank; and a determining unit which determines a condition of the maintenance process to be performed after the replacement depending on detection of the replacement by the detector, wherein the determining unit determines the condition so that an amount of ink to be discharged from the printing head in the maintenance process in a case where the replacement of an in-use ink tank having a remaining amount less than a predetermined amount with a new ink tank is performed is more than that in a case where the replacement of an in-use ink tank having a remaining amount more than the predetermined amount with a new ink tank is performed, and wherein the remaining amount of the in-use ink tank is determined based on the information obtained by the obtaining unit.

2. The ink jet printing apparatus according to claim 1, wherein the maintenance process is at least one of a suction recovery process for sucking ink from the ejection opening and a preliminary ejection process for preliminarily ejecting ink from the ejection opening.

3. The ink jet printing apparatus according to claim 2, wherein the printing head includes a plurality of ejection openings for ejecting a plurality of inks supplied from different ink tanks, and wherein, in the suction recovery process, the plurality of inks are forcedly discharged from the plurality of ejection openings into a capping unit while the plurality of ejection openings are being capped with the capping unit.

4. The ink jet printing apparatus according to claim 1, wherein the ink tank is an air-tight type ink tank whose inside does not communicate with the atmosphere.

5. A method of performing a maintenance process for an ink jet printing apparatus for printing an image on a printing medium by using a printing head including an ejection opening for ejecting ink and a replaceable ink tank which contains the ink for supply to the printing head, the maintenance process discharging the ink from the printing head, comprising the steps of:

detecting a replacement of the ink tank;

obtaining information representing an amount of ink consumed from the ink tank;

determining a condition of the maintenance process to be performed after the replacement depending on detection of the replacement in the detecting step; and performing the maintenance process according to the condition determined in the determining step, wherein, in the determining step, the condition is determined so that an amount of ink to be discharged from the printing head in the maintenance process in a case where the replacement of an in-use ink tank having a remaining amount of ink less than a predetermined amount with a new ink tank is performed is more than that in a case where the replacement of an in-use ink tank having a remaining amount of ink more than the predetermined amount with a new ink tank is performed, and wherein the remaining amount of the in-use ink tank is determined based on the information obtained in the obtaining step.

* * * * *